US005997118A

United States Patent [19]

McBrayer et al.

[11] Patent Number: 5,997,118

[45] Date of Patent: Dec. 7, 1999

[54] DURABLE FURNITURE ARTICLES

[75] Inventors: John Harrill McBrayer, New Braunfels; William Henry Joiner, III, San Antonio, both of Tex.

[73] Assignee: KLN Steel Products Company, Ltd., San Antonio, Tex.

[21] Appl. No.: 08/825,016

[22] Filed: Mar. 26, 1997

[51] Int. Cl.[6] ..... A47B 88/00

[52] U.S. Cl. ..... 312/334.44; 312/348.4

[58] Field of Search ..... 312/348.4, 348.1, 312/330.1, 334.44, 244

[56] References Cited

U.S. PATENT DOCUMENTS

| | | | |
|---|---|---|---|
| D. 129,484 | 9/1941 | Jiranek . | |
| D. 222,080 | 9/1971 | Carlson . | |
| D. 240,184 | 6/1976 | Neuschaefer . | |
| D. 258,032 | 1/1981 | Tebbe et al. . | |
| D. 263,265 | 3/1982 | Henley, Jr. . | |
| D. 274,963 | 8/1984 | Brunner et al. . | |
| D. 318,582 | 7/1991 | Hollington . | |
| D. 340,820 | 11/1993 | Frischer . | |
| D. 346,712 | 5/1994 | Brunner et al. . | |
| D. 365,224 | 12/1995 | Pohlman . | |
| 1,222,451 | 4/1917 | Ohnstrand | 312/348.4 |
| 3,179,480 | 4/1965 | Brinker | 312/348.4 |

*Primary Examiner*—Peter M. Cuomo
*Assistant Examiner*—Gerald A. Anderson
*Attorney, Agent, or Firm*—Akin, Gump, Strauss, Hauer & Feld

[57] ABSTRACT

Durable furniture articles include a desk having a desktop supported on an apron which is supported between opposed depending side panels. A modesty panel is also interconnected between the side panels and a carrel is disposable on the desk. A desk drawer is formed by a foldable bottom panel, opposed side panels and a rear wall, all of which include flanges which are weldable together at contiguous surfaces thereof. Lock hasps are disposed on the drawer bottom to cooperate with a reinforcing member of the apron to lock the drawer in a closed position, hidden from view and comprising parts which are not easily disassembled. A chest of drawers assembly is formed by a perimeter formed metal frame, opposed side panels, a shallow pan back wall, a top perimeter apron and a top panel member. A modular wardrobe unit or storage unit includes a sheet metal enclosure, opposed side panels and a formed sheet metal base frame. Vertically stackable beds are characterized by spaced apart tubular posts interconnected by a folded metal deck or pan. L-shaped anchor brackets may be inserted in the tops of the posts and are secured to the bottom edges of posts of another bed so that the beds may be vertically stacked and anchored to each other.

4 Claims, 17 Drawing Sheets

FIG. 19A
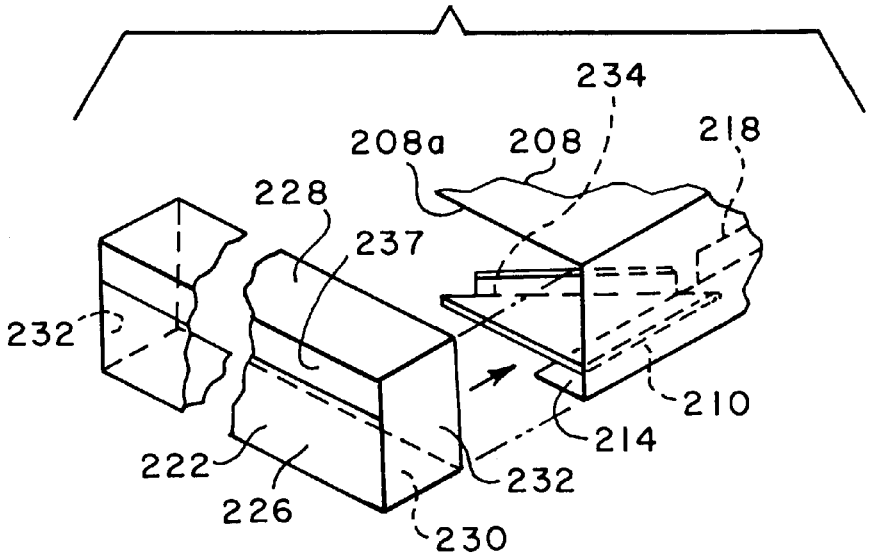
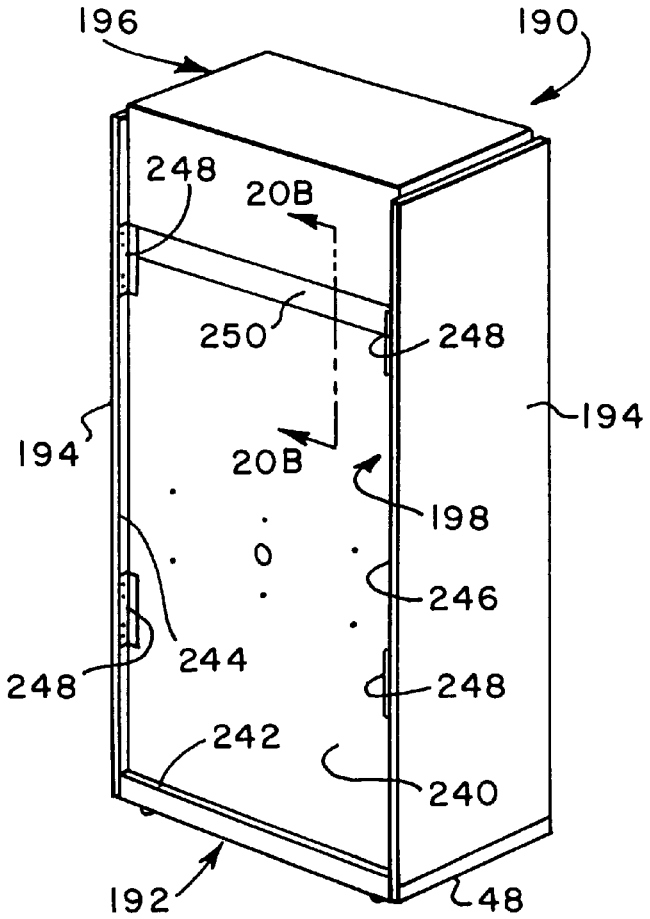
FIG. 20

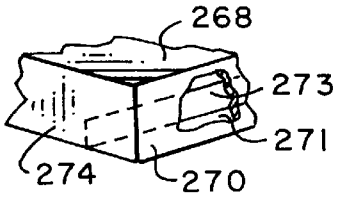
FIG. 22A
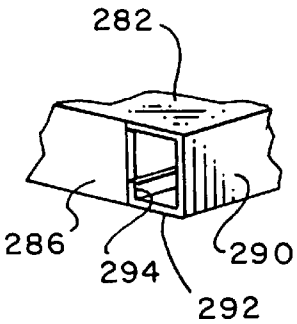
FIG. 22B
FIG. 22
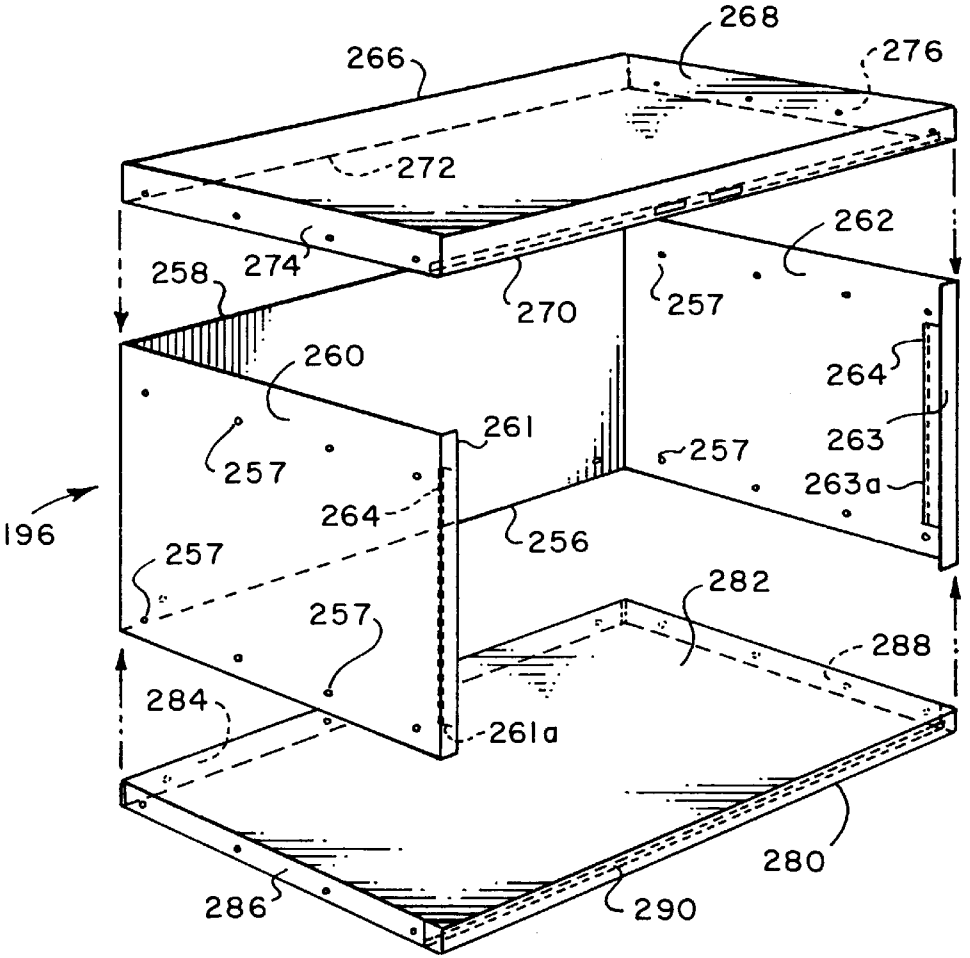

DURABLE FURNITURE ARTICLES

FIELD OF THE INVENTION

The present invention pertains to durable, aesthetically pleasing furniture articles including a desk, a chest, a storage and/or wardrobe unit, and a bunk bed connection arrangement, all particularly adapted for use in institutional settings.

BACKGROUND

Furniture for institutional settings must meet certain requirements. The furniture must be particularly durable, yet aesthetically pleasing and be constructed of a minimum number of uncomplicated parts which are economical to manufacture and assemble. Moreover, the furniture should be difficult to disassemble so that the furniture or parts thereof cannot be easily vandalized or stolen, used in performing pranks, used as a weapon or utilized in taking unauthorized leave of an institutional setting.

One particular furniture article usually found in institutional settings comprises a desk. An increasingly common requirement for desks is that they be particularly adapted for supporting electronic devices such as digital computers and related equipment and that certain security for such equipment be provided. Other desirable features in durable furniture articles have been sought with respect to the construction of cabinets, carrels, chests of drawers, wardrobe units and similar structures wherein simplified construction of the article is desired while providing an aesthetically pleasing structure. Bed structures, in institutional settings, when stacked one on top of the other in so-called "bunk bed" fashion, must be properly secured to each other and be constructed in such a way as to provide for easy stacking and unstacking of the beds without requiring complicated assembly and disassembly.

The present invention has been directed to providing durable furniture articles which overcome the deficiencies of prior art furniture while providing the desired features mentioned above.

SUMMARY OF THE INVENTION

The present invention provides improvements in durable furniture articles such as desks, cabinets or wardrobe units, and beds, particularly vertically stackable beds or so-called "bunk beds." The invention also provides a suite of furniture articles having a combination of features in one or more articles which provide for durability and aesthetic appeal.

In accordance with one aspect of the present invention a furniture article comprising a desk is provided with a unique construction which allows the routing of electrical cables and the like between the desk and a remote location while avoiding unsightly and undesirable positioning of the cables. The desk has unique structural features of a desktop, spaced apart side panels and a rear modesty panel constructed and arranged in such a way as to be durable and aesthetically pleasing. The desk also provides for convenient routing of electrical cables and the like between electronic devices mounted on the desk and terminals for such cables or wiring. The desk includes a drawer for a computer keyboard or the like. The desk also includes a drawer structure with concealed lock hasps, which is durable, uncomplicated and aesthetically pleasing.

In accordance with another aspect of the present invention, a furniture article comprising a chest of drawers is provided comprising opposed side panels, a back panel, an apron, structure for supporting plural slide drawers and drawers which may be conveniently opened and closed, and a drawer head which may be easily modified for aesthetic purposes or style. The chest of drawers also provides a conveniently supported drawer stop for each drawer to prevent inadvertent or unwanted removal of the drawers from the chest.

In accordance with yet another aspect of the present invention furniture articles comprising vertically stackable beds or so-called "bunk beds" are provided of unique, uncomplicated construction. In particular, a bunk bed is provided with spaced apart corner posts configured such that stacked beds may be interconnected by a support structure which prevents unwanted or inadvertent separation or disassembly of the beds from each other but allows bunking (stacking or unstacking) of the beds without disassembly of any one of the beds. In particular, a support between the posts of vertically stacked beds is provided which prevents inadvertent separation of the beds, is not easily disconnected from either bed, and provides an aesthetically pleasing unobtrusive connection structure.

In accordance with still another aspect of the invention, a cabinet-like storage unit is provided which is preferably constructed of both wood and metal parts and is arranged in such a way that a base frame, a back wall assembly, a top mounted storage enclosure and outer side panels may be utilized to provide a complete enclosure or wardrobe unit as well as a partially open storage unit having separate upper and lower cabinets. The modular construction of the storage unit or cabinet as well as the wardrobe unit provides for use of a substantial number of common parts and the parts are particularly durable, aesthetically pleasing and are of improved construction.

Those skilled in the art will further appreciate the above-mentioned advantages and superior features of the invention together with other important aspects thereof upon reading the detailed description which follows in conjunction with the drawings.

BRIEF DESCRIPTION OF THE DRAWING

FIG. 19A is a detail perspective view showing portions of members of the base frame of FIG. 19;

FIG. 20 is a perspective view showing the back wall for the enclosure or wardrobe unit shown in FIG. 17;

FIG. 22 is an exploded perspective view of an enclosure or cage for the wardrobe unit shown in FIG. 17;

FIGS. 22A and 22B are detail views on a larger scale of the portions of FIG. 22 indicated, respectively;

DESCRIPTION OF THE PREFERRED EMBODIMENTS

Figure 1:
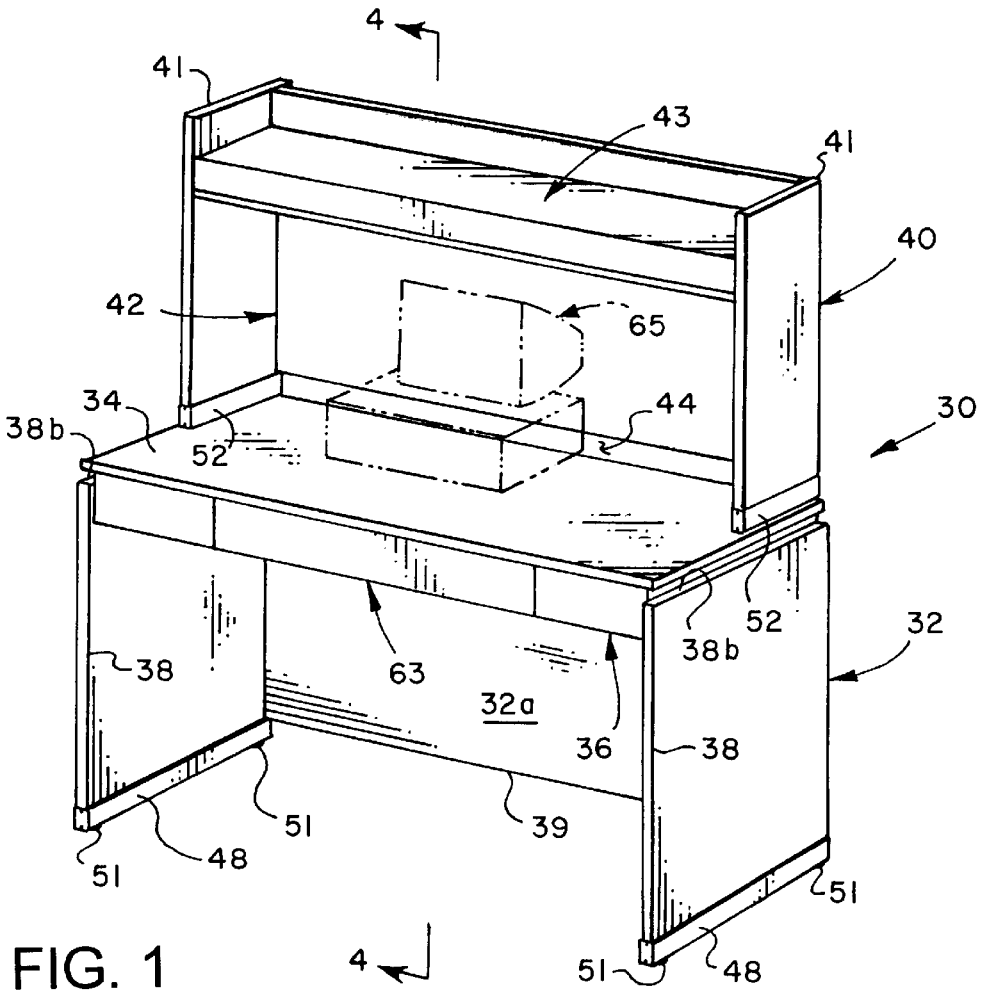
FIG. 1 is a front perspective view of a desk and a carrel in accordance with the preferred embodiment of the present invention.

Referring to FIG. 1, there is illustrated a desk and desktop carrel in accordance with the invention and generally designated by the numeral 30. The desk and carrel 30 is characterized by a desk 32 comprising a generally planar rectangular desktop member 34 supported on a desktop apron 36, opposed, generally planar, rectangular side panels 38 secured to opposite sides of the apron 36, and a generally planar, rectangular modesty panel 39 interposed between the side panels 38 and extending substantially vertically adjacent a rear edge of the side panels 38, respectively.

Figure 2:
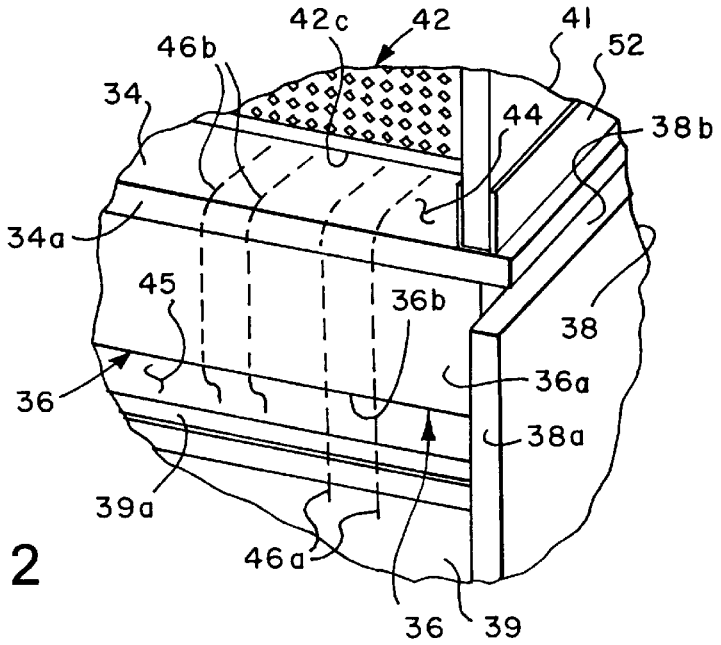
FIG. 2 is a detail view taken from the back side of the desk of FIG. 1 showing the routing of electrical cables.
Figure 4:
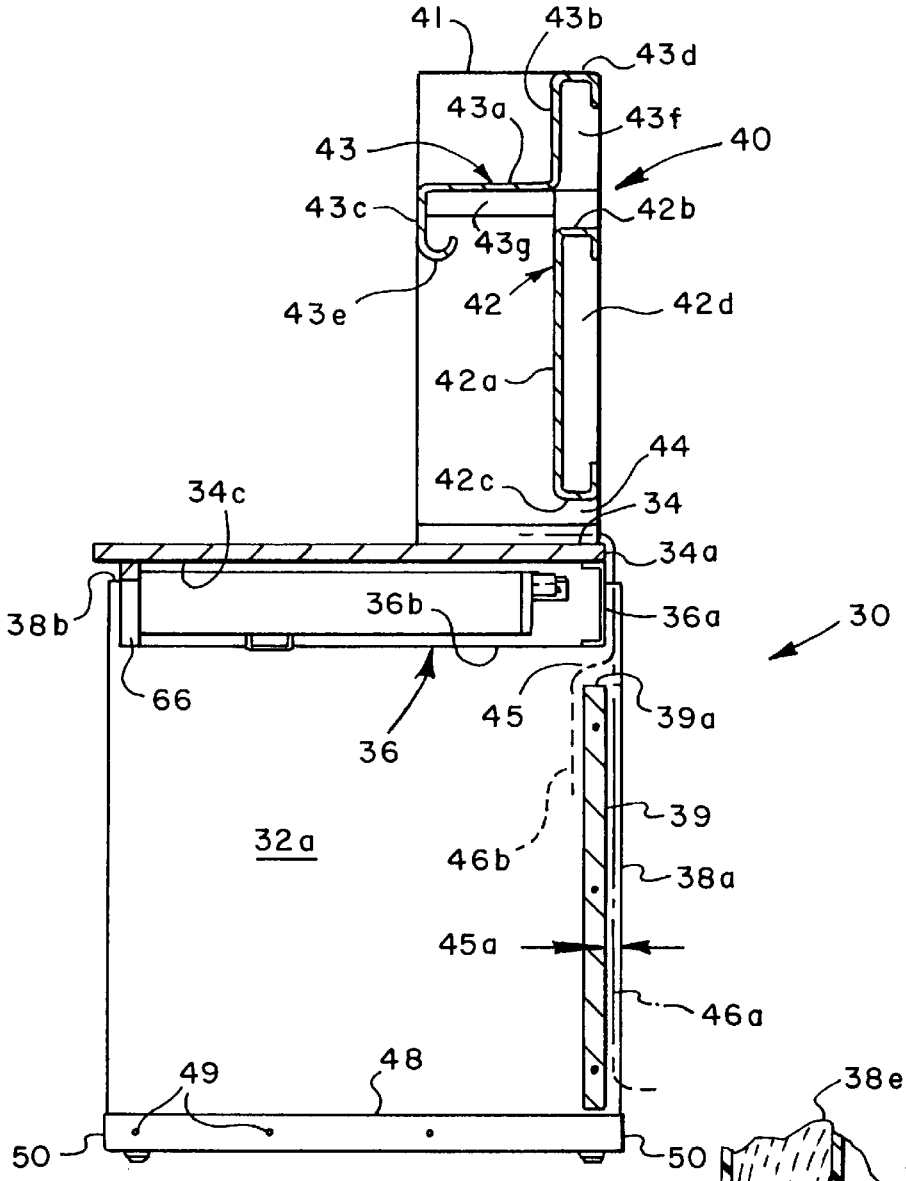
FIG. 4 is a section view taken generally along the line 4—4 of FIG. 1.

An optional carrel 40 is shown disposed on the desktop 34 and is characterized by opposed generally rectangular planar side panels 41 and a generally planar rectangular back panel 42 connected to the side panels 41 and extending substantially vertically along a rear edge of each of the side panels 41. As shown also in FIG. 4, the back panel 42 is preferably formed of a folded metal plate having a generally rectangular planar portion 42*a* which may be perforated, as shown in FIG. 2, and opposed folded longitudinal edges 42*b* and 42*c*. The opposite lateral ends of the planar portion 42*a* are folded over at 42*d*, for example, so that the back panel may be suitably secured to the side panels 41 by suitable fasteners, not shown. As shown in FIG. 4, the height of the back panel 42 is less than the height of the side panels 41 so that, when the carrel 40 is disposed on the desktop 34, a gap 44 is formed between the lower side edge 42*c* of the back panel 42 and the upper surface of the desktop 34.

Referring further to FIG. 4, the carrel 40 also includes an elongated folded metal shelf member 43 having a generally horizontally extending shelf portion 43*a* integrally formed with a vertical back panel portion 43*b*. The shelf portion 43*a* and the back panel 43*b* are contiguous, respectively, with a depending face portion 43*c* and a folded over top edge 43*d*. The face portion 43*c* preferably terminates in a folded over light valance portion 43*e*. The opposite side edges of the shelf 43 have folded over end plate portions 43*f* and 43*g*, one of each shown in FIG. 4, whereby the shelf 43 may be suitably secured to the side panels 41 by suitable fasteners, not shown.

As shown in FIGS. 1, 2 and 4, an upper horizontal side edge 39*a* of the modesty panel 39 is disposed spaced from and below the desktop 34. The panel side edge 39*a* is also spaced from and below the apron 36 to provide a gap 45 between the apron 36 and the side edge 39*a* which extends between side panels 38. The rear side edge 34*a* of the desktop 34 is preferably coplanar with the rear side edge 36*a* of the apron 36 and these edges are disposed forwardly from the rear side edges 38*a* of the side panels 38 as shown in FIG. 4. In like manner, the modesty panel 39 is also spaced forward of the rear side edges 38*a* of the side panels 38 to provide a space 45*a*. Electrical cables 46*a*, for example, may also be trained along the top surface of desktop 34, through gap 44 over the side edge 34*a* and downwardly along the rear facing surface of the modesty panel 39 in the space 45*a* formed between the side panels 38 and the modesty panel 39. Electrical cables 46*b*, for example, may also be trained through gap 44 over the rear side edge 34*a* of the desktop 34 and through the gap 45 into the space 32*a* formed by the desktop 34, the side panels 38 and the modesty panel 39.

With the advent of many electrical devices adapted to be situated on a desktop, desks used in many applications must accommodate a large number of electrical cables which are not easily trainable between conventional desks and remotely disposed equipment and other communications or power cables. However, with the arrangement described above and shown in conjunction with the desk 32 and the carrel 40, cables 46*a* and 46*b*, for example, may be easily trained through the gap 44, over the edge 34*a* of the desktop and either through the gap 45, as shown in FIG. 2, to be disposed within the space 32*a* between the side panels 38 and the modesty panel 39, or down through the chase formed by space 45*a*.

Accordingly, the desk 32 alone and in combination with the carrel 40 is advantageously configured to accommodate electrical cables such as the cables 46*a* and 46*b* for training the cables along the back of the desk, unobtrusively, and for training the cables from the desktop 34 to the space 32*a* beneath the desktop and between the side panels 38. This is accomplished by the arrangement of the modesty panel 39 with respect to the side panels 38 and the arrangement of the desktop 34 and its support apron 36, and further with respect to the modesty panel 39 and the rear edges 38*a* of the side panels 38.

Figure 5:
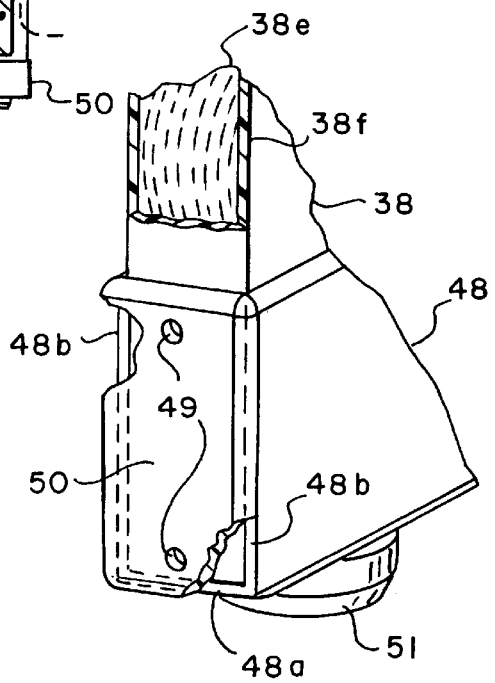
FIG. 5 is a detail perspective view of a mop guard for the lower edge of one of the side panels of the desk of FIG. 1.

Referring again to FIGS. 1, 4 and 5, the side panels 38 are provided with protective guards 48 disposed along their lower side edges, respectively. As shown in FIG. 5, the guards 48 are formed as elongated channel members having a web 48*a* interconnecting opposed elongated parallel flanges 48*b*. Opposed end caps 50, one shown in FIG. 5, are disposed across the opposed front edges of the panel members 38 which are not covered by the guards 48. The guards 48 and end caps 50 may be formed of a suitable plastic material and are suitably secured to the side panels 38 by conventional fasteners 49.

The side panels 38 and the desktop 34, may be fabricated of laminated wood panels having a conventional solid wood or plywood core, such as the core 38*e* for the side panel 38, as shown in FIG. 5, and covered with a laminated plastic sheetlike covering 38*f*, also shown in FIG. 5. As shown in FIG. 1 and FIG. 5, the side panels 38 are supported on spaced apart feet or glides 51 of conventional construction. The lower side edges of the panels 41 of the carrel 40 are also provided with plastic channel shaped guard parts 52 as shown in FIGS. 1 and 2. As also shown in FIG. 2, the back panel 42 of the carrel 40 is perforated for aesthetic, acoustic and air circulation purposes, as well as for accommodating standard pegboard hooks or magnets. The panels 41 may be constructed in a manner similar to the panels 38. The modesty panel 39 may be a metal plate folded over at its top and bottom edges or the modesty panel may be fabricated in the same manner as the panels 38.

Figure 3:
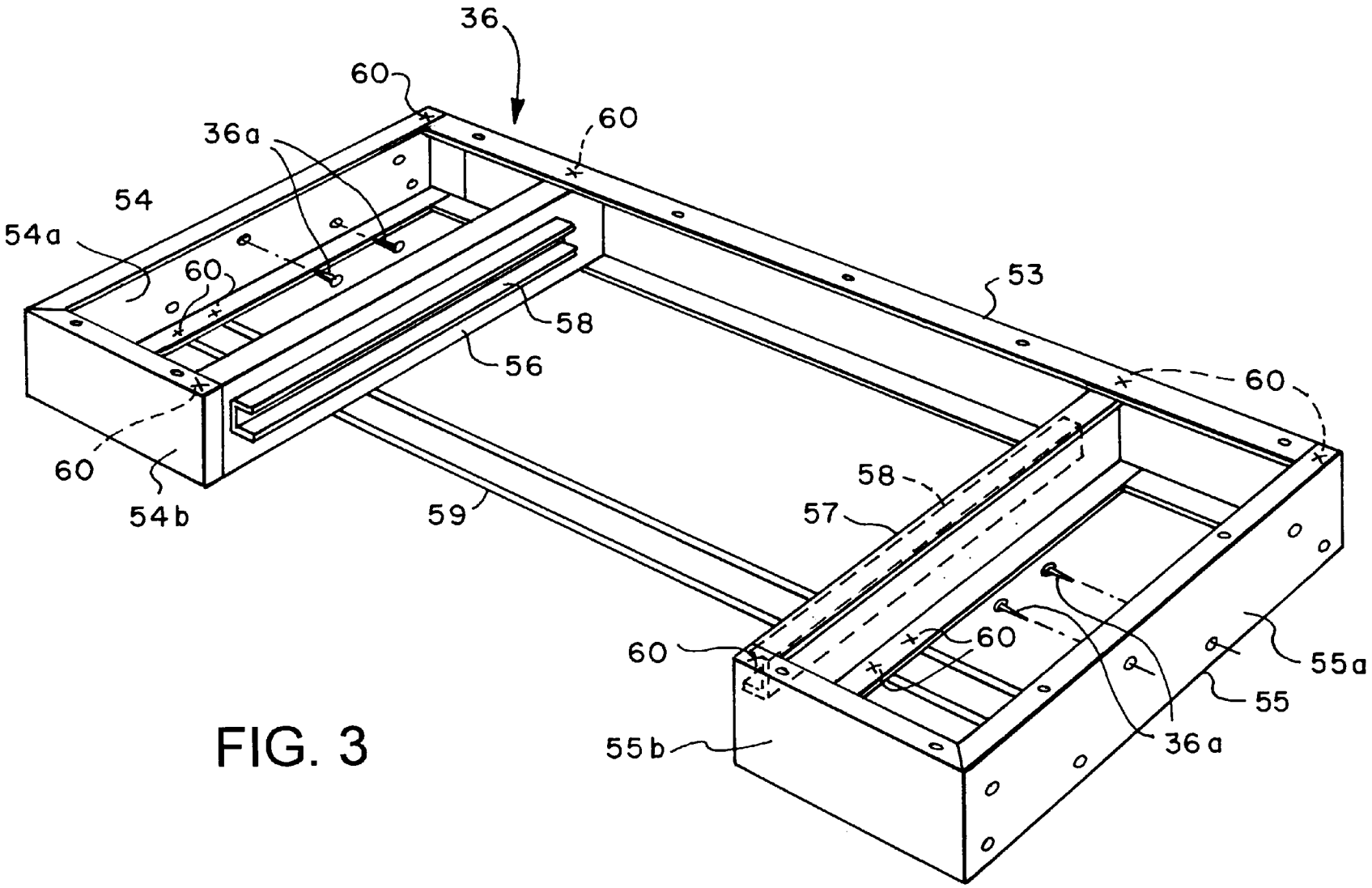
FIG. 3 is a perspective view of a desktop apron assembly in accordance with the preferred embodiment of the present invention.

Referring now to FIG. 3, the apron 36 is preferably constructed of structural metal members including an elongated rear transverse channel part 53 and opposed outer channel parts 54 and 55 extending normal to channel part 53. The members may be fabricated by appropriate cutting and folding of metal plate to form the side portions 54*a* and 55*a* as well as transverse front facing channel portions 54*b* and 55*b*. Inner longitudinal drawer support channels 56 and 57 are connected to the channel portions 54*b* and 55*b*, respectively, and extend to the rear channel 53. Each of the channel parts 56 and 57 supports a conventional drawer slide and support channel member 58. An elongated, transverse, shallow channel shaped reinforcing member 59 extends between the channel portions 54*a* and 55*a* and is spaced from and substantially parallel to the channel 53 and the channel portions 54*b* and 55*b*. The channel shaped parts 53, 54, 55, 56, 57 and 59 may be suitably welded together at the edges of these respective members which are contiguous with each other to form the apron 36. Such welds may comprise resistance type spot welds at appropriate overlapping surfaces. Representative spot welds 60 are shown in FIG. 3 where contiguous surfaces of the respective channel members occur. The drawer slide channels 58 may also be welded to the channel parts 56 and 57.

The above-described apron 36 is a substantially rigid, indestructible member and is suitably connected to the side panels 38 at the respective channel parts 54*a* and 55*a* by conventional threaded fasteners 36*a*. Fasteners 36*a* may be inserted through suitable fastener receiving openings in the channel parts 54*a* and 55*a* into the facing surfaces of the panels 38 so that the fasteners do not show from the exterior surfaces of the panels 38. Conventional wood screws, for example, may be used to secure the panels 38 to the apron 36. As shown in FIGS. 1, 2 and 4, the top side edges 38*b* of the side panels 38 are advantageously spaced from the lower surface 34*c* of the desktop 34, primarily for aesthetic purposes so as to expose a portion of the channels 54*a* and 55*a* to view from the exterior of the desk.

Figure 6:
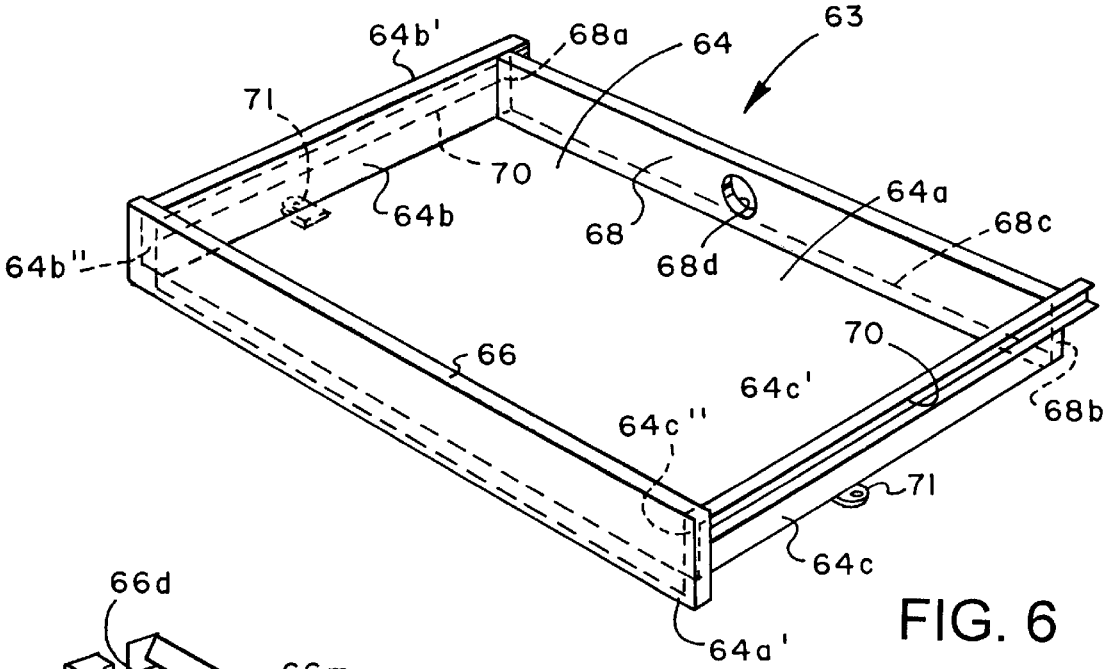
FIG. 6 is a perspective view of a drawer for the desk shown in FIG. 1.

Referring further to FIG. 1 and FIG. 6, the desk 32 is provided with a slidable drawer 63 which is adapted to slide on the slide members 58 between open and closed positions in a generally conventional manner. The drawer 63 includes a folded metal plate body 64 having a bottom part or web 64*a* and a depending flange 64*a*' and opposed upstanding side parts 64*b* and 64*c*. Each of the sides 64*b* and 64*c* is folded to form a flange 64*b*' and 64*c*', respectively. The forward side edges of the sides 64*b* and 64*c* are also provided with transverse flange portions 64*b*41 and 64*c*" substantially coplanar with flange 64*a*' for attaching a drawer front wall or head part 66 to the body 64. A back wall 68 extends between the sides 64*b* and 64*c* and includes opposed end flanges 68*a* and 68*b* and a bottom flange 68*c* which are suitably spot welded to the sides 64*b* and 64*c* and the web 64*a*, respectively. Respective drawer slide channels 70 are supported on the outer sides of the side parts 64*b* and 64*c*, as shown, and are suitably spot welded thereto and cooperate with the slides 58 and suitable slide mechanism (not shown) of conventional design, to provide for sliding movement of the drawer 63 with respect to the apron 36.

Figure 7:
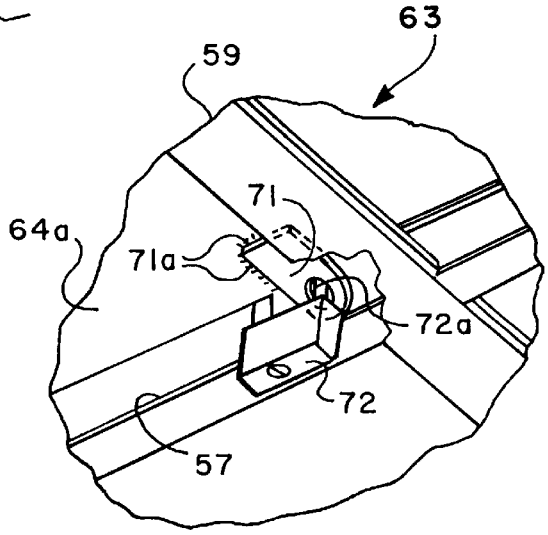
FIG. 7 is a detail perspective view showing a lock arrangement for the desk and drawer of FIGS. 1 and 6.

Referring to FIG. 6, at least two opposed lock hasps 71 are secured to the bottom web part 64*a* of the body 64 and project outwardly from each side 64*c*. As illustrated in FIG. 7, by way of example, each hasp 71 is suitably welded at 71*a* to the web 64*a* and is operable to support a conventional padlock 72 wherein a shackle 72*a* of the padlock projects through a bore in the hasp. When the drawer 63 is mounted on the apron 36 and is in a closed position, the hasps 71 are disposed with respect to the reinforcing member 59 such that, upon supporting a lock 72 on either or both of the hasps 71, the drawer 63 is locked in a closed position. In this way, the drawer 63 may be conveniently locked without requiring a lock mechanism in the head part 66 or the desktop 34 and the lock is also concealed to foil someone who may consider attempting to forcibly open drawer 63.

As shown in FIG. 6, the back wall 68 of the drawer body is also conveniently provided with a port 68*d* for training electrical cables therethrough so that a computer keyboard or the like may be mounted in the drawer 63 and have a convenient opening for training conductor cables between the keyboard and a computer 65 disposed on the desktop 34, for example, as shown in FIG. 1.

Figure 6A:
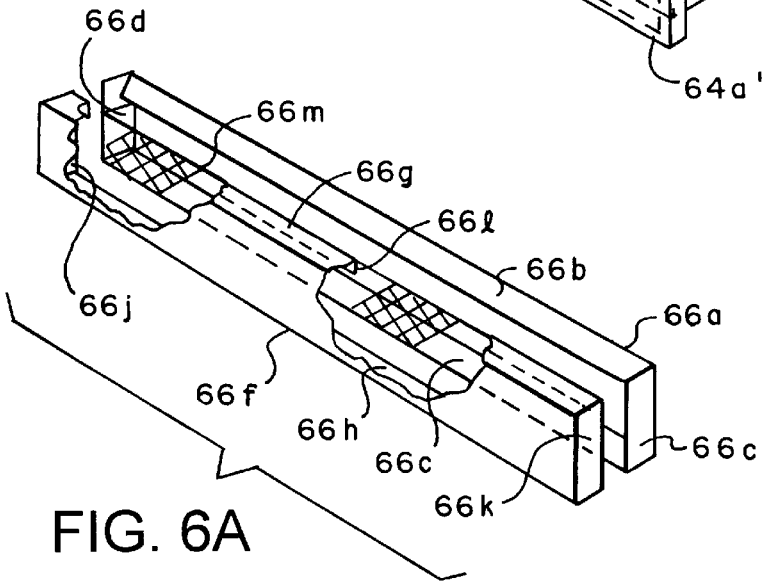
FIG. 6A is an exploded perspective view of the drawer head for the drawer of FIG. 6.

Referring now to FIG. 6A, the head part 66 is characterized by a generally rectangular shallow metal pan 66*a* which may be formed of a single sheet of metal plate folded to form top and bottom side edges 66*b* and 66*c* and opposite side edges 66*d* and 66*e*. The top side edge 66*b* is folded beyond 90° to facilitate assembly of a cover part for the head part 66 which comprises a substantially shallow rectangular metal pan 66*f* which is also formed of a metal plate which is folded to provide top and bottom flanges or web portions 66*g* and 66*h* together with opposite side edges 66*j* and 66*k*. The top side edge 66*g* has an in-turned depending flange 66*l*. The dimensions of the cover part 66*f* are such that it may provide for nesting the inner pan 66*a* within the outer pan or cover part 66*f* with the flange 66*l* hooked over the top side edge 66*b*. An insulating panel 66*m* is provided for insertion within the pan 66*a* and retained by the pan or cover part 66*f* when the two pan-shaped parts of the head 66 are assembled to each other and suitably welded along their contiguous edges in assembly. Cover part 66*f* may be interchanged with outer cover parts, as desired, on initial assembly. Pan 66*a* may be secured to flanges 64*a*', 64*b*' and 64*c*' by mechanical fasteners or, preferably, by welding.

Those skilled in the art will recognize from the foregoing description of the desk 32 that it is advantageously fabricated to be particularly durable, is of uncomplicated construction and yet is aesthetically pleasing and functional.

Figure 8:
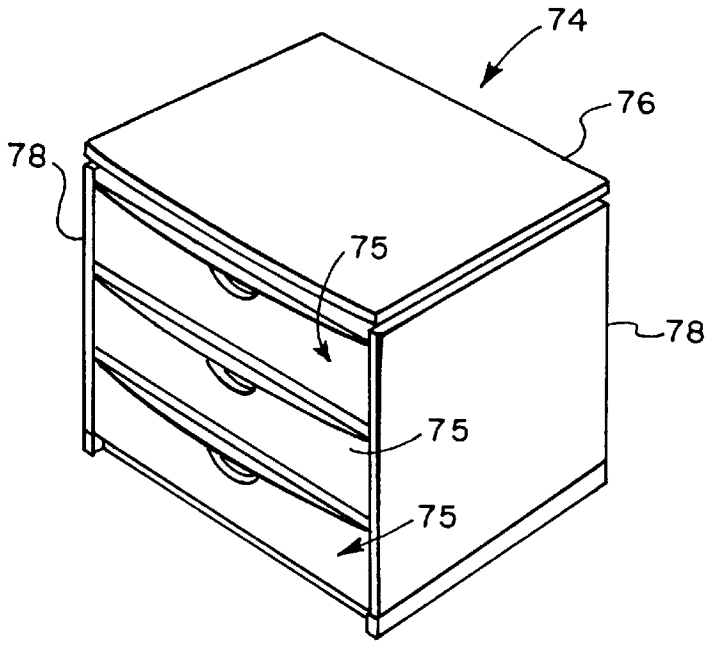
FIG. 8 is a perspective view of a chest of drawers assembly in accordance with the preferred embodiment of the present invention.
Figure 9:
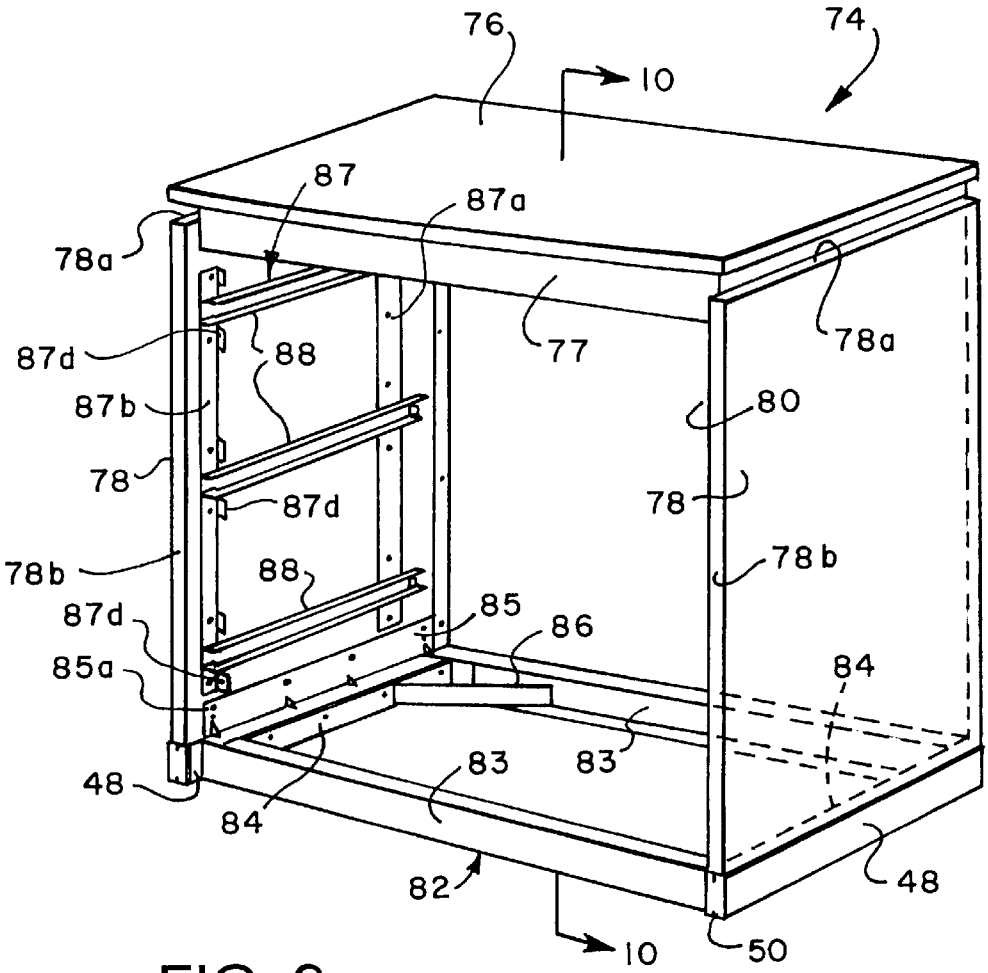
FIG. 9 is a perspective view of the chest shown in FIG. 8 with the drawers removed therefrom.

Referring now to FIGS. 8 and 9, another durable article of furniture in accordance with the invention is illustrated in the form of a chest of drawers assembly 74. The chest assembly 74 includes three slidable drawers 75 supported thereon. The chest assembly 74 also includes a generally rectangular, planar, horizontally disposed top panel 76 supported on an apron 77 opposed depending side panels 78, which are of generally rectangular planar configuration and a rear panel or back wall 80 interposed between the side panels and the underside of the apron 77. The chest assembly 74 also includes a perimeter type base frame 82 which is attached to the respective side panels 78 along respective lower inside portions thereof.

Figure 10:
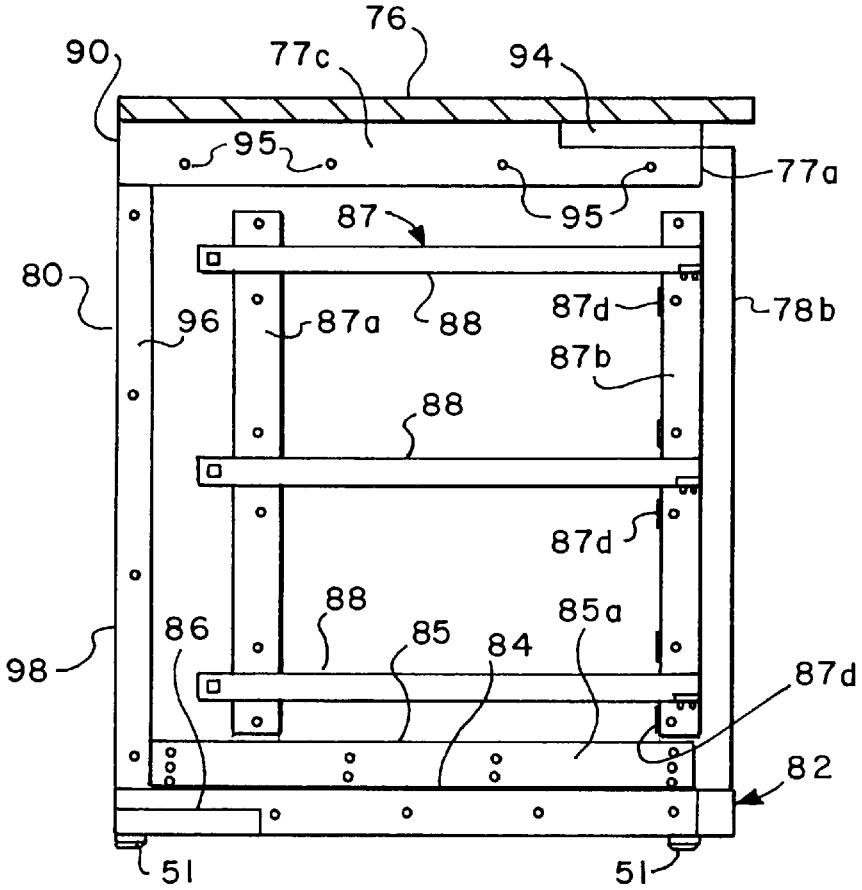
FIG. 10 is a section view taken generally from the line 10—10 of FIG. 9.

As further shown in FIGS. 9 and 10, the base frame 82 is characterized by a perimeter channel member which comprises spaced apart, parallel inwardly facing channel sections 83 and opposed, spaced apart and parallel inwardly facing channel sections 84. The channel sections 83 and 84 may be suitably fastened to each other at their contiguous edges by spot welds, for example. An elongated L-shaped support bracket 85 is disposed on and forms a part of the base frame 82 and extends along each of the channel members 84. Each bracket 85 has an upstanding leg 85*a* to provide for connecting the side panels 78 to the base frame 82 by conventional threaded fasteners. Suitable gussets 86 extend between the side frame members 84 and the rear transverse frame member 83 and are suitably welded to these members at the opposite ends of the gussets to increase the rigidity of the base frame 82.

As also shown in FIGS. 9 and 10, each of the side panels 78 supports a drawer slide assembly 87 having spaced apart generally parallel drawer slide guide channel members 88 of conventional construction supported thereon. The drawer slide guide assemblies 87 are suitably secured to the panels 78 by conventional threaded fasteners. The drawer slide guide assemblies 87 include spaced apart upstanding support members 87*a* and 87*b* which support the respective channel-shaped guides 88.

Figure 9A:
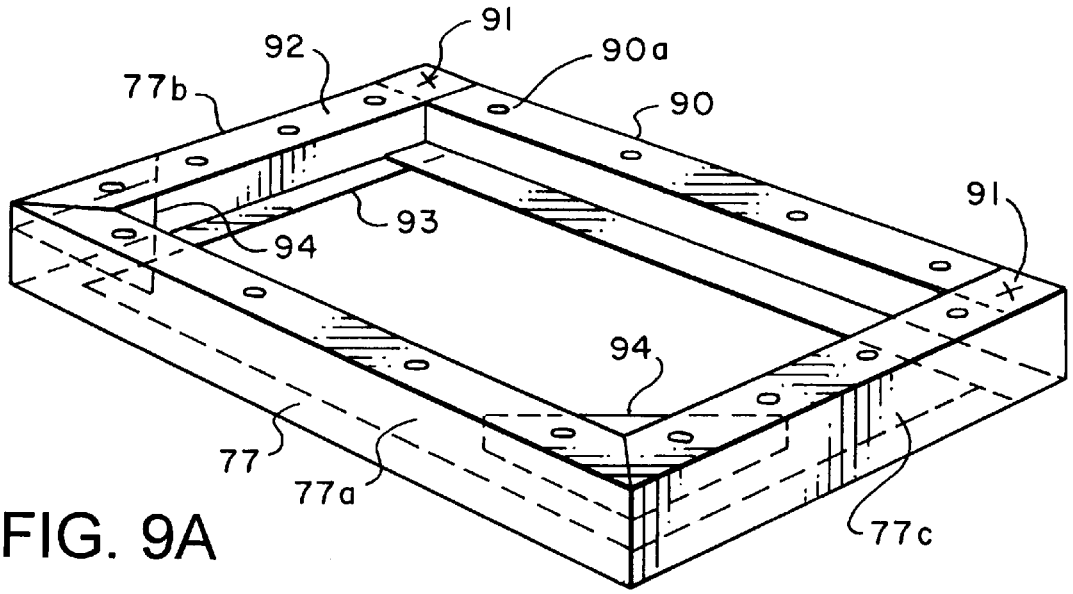
FIG. 9A is a perspective view of an apron for the chest shown in FIGS. 8 through 10.

Referring to FIGS. 9A and 10, the apron 77 is preferably characterized by a generally rectangular perimeter channel structure wherein at least three sides 77*a*, 77*b* and 77*c* may be formed of a single member folded at the front corners of the chest assembly 74 to form a substantially U-shaped member and wherein a separate channel shaped member 90 may extend between the channel legs 77*b* and 77*c* and be suitably welded thereto at welds 91, for example, to form the perimeter rectangular apron 77. The channel shaped member 77*a*, 77*b*, 77*c* may also be formed in such a way that an upper flange portion 92 has a width greater than a lower flange portion 93 to provide adequate support for the top panel 76 and to facilitate assembly of the top panel 76 to the apron by suitable threaded fasteners which secure the top flange 92 along all three sides 77*a*, 77*b* and 77*c* to the top panel 76. The top panel 76 may also be suitably secured by threaded fasteners (not shown) to the top flange 90*a* of the channel member 90. Suitable gussets 94 extend between the web portions of the sides 77*a*, 77*b* and 77*c*, as shown in FIG. 9A, and are suitably welded thereto, respectively. The apron 77 is secured to the side panel 78 along the respective apron side channel portions 77*b* and 77*c* by suitable threaded fasteners, as indicated at 95 in FIG. 10.

The back wall or panel 80 of the chest assembly 74 is preferably formed of metal plate having a perimeter flange 96 extending at right angles to a generally planar panel part 98 and formed integral therewith by bending a sheet of metal along four opposed sides to form a relatively shallow pan. The panel 80 is then suitably secured by conventional threaded fasteners, for example, to the side panels 78, the channel member 90 of the apron 77 and the rear channel member 83 of the base frame 82 along the perimeter flange 96 at the respective contiguous portions of the flange with the respective members of the chest assembly. As indicated in FIGS. 8 and 9, the top panel 76 is spaced from the top side edges 78*a* of the side panels 78 as a result of the particular point of attachment of the side panels to the apron 77. Moreover, the front side edges 78*b* of the side panels 78 extend beyond the plane of the side 77*a* of the apron 77 to accommodate the front or head portion of the drawers 75 so that, in the closed positions of the drawers, the head portions are substantially coplanar with the front edges 78*b*. As shown in FIG. 10, the lower side edges of the panels 78 are covered by channel-shaped guards 48 including end caps 50 in the same manner as the side panels 38 of the desk 32. The panels 76 and 78 may also be fabricated of the same materials and have the same construction as the panels 38 as described above and shown in FIG. 5. Any or all of the panels 76, 78 and 38 may have the laminated plastic covering applied to the outwardly facing surfaces of the panels or to all surfaces, if desired. Suitable glides 51 are connected to the base frame 82 for supporting the chest assembly 74.

Figure 11:
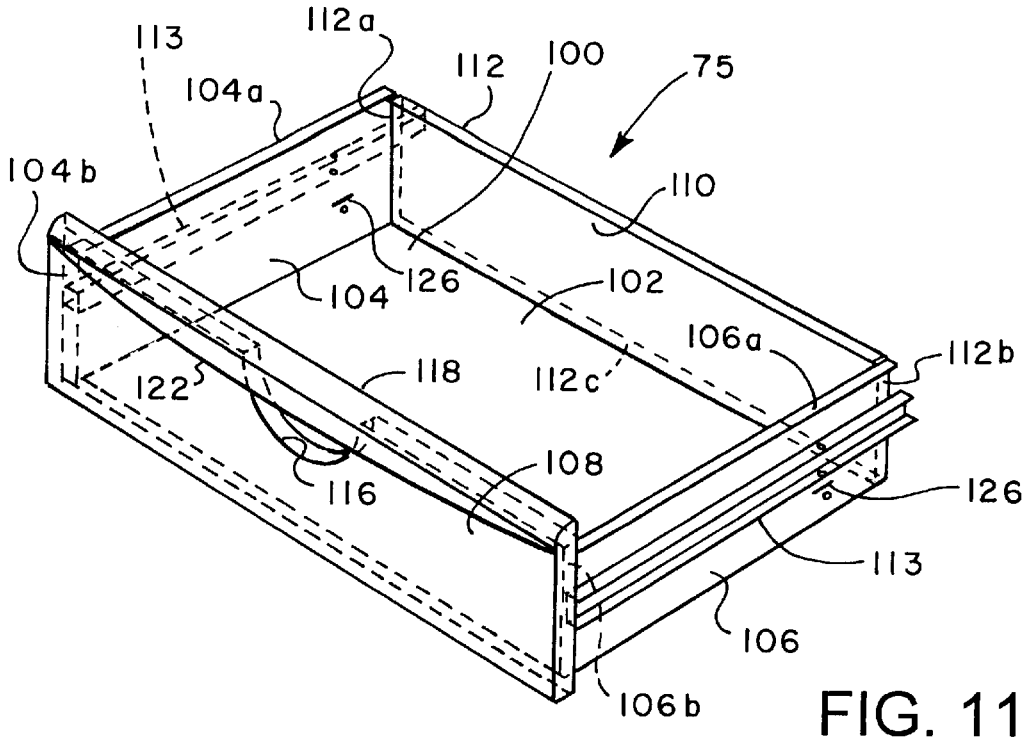
FIG. 11 is a perspective view of one of the drawers for the chest shown in FIGS. 8 through 10.
Figure 12:
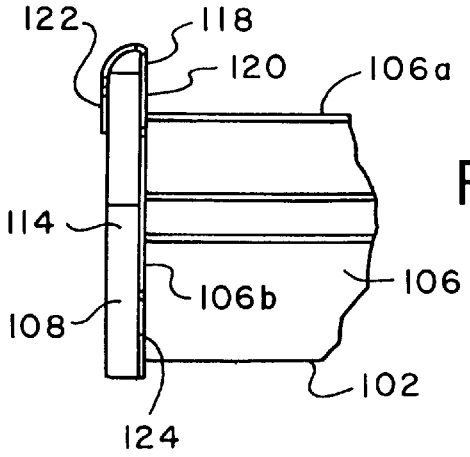
FIG. 12 is a partial side elevation of the drawer shown in FIG. 11.
Figure 13:
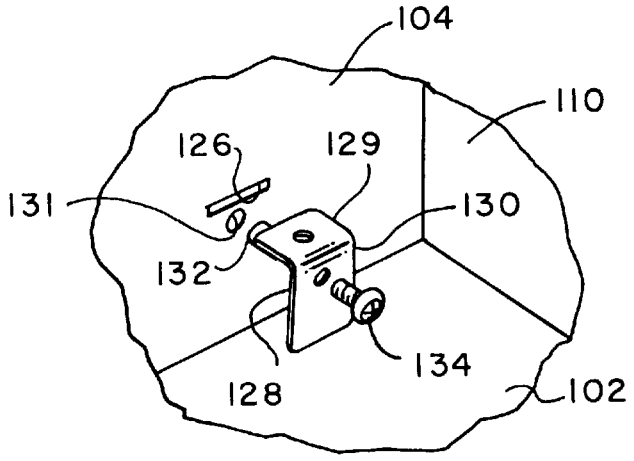
FIG. 13 is a detail perspective view showing a stop assembly for the drawer of FIG. 11.

Referring now to FIGS. 11, 12 and 13, one of the drawers 75 is illustrated and will be described in further detail herein. Each drawer 75 includes a drawer body 100 preferably formed of metal plate which is folded to provide a body bottom part 102 and opposed side parts 104 and 106. Accordingly, a sheet of metal plate may be folded at the lines forming junctures between the bottom part 102 and the respective upstanding and parallel side parts 104 and 106. The top edges of the side parts 104 and 106 are also folded to form substantially coplanar flanges 104*a* and 106*a*, respectively. Flanges 104*b* and 106*b* are formed along the front side edges of the side parts 104 and 106 for connecting a drawer front head 108 to the drawer body at the respective flanges. The drawer 75 includes a body back panel 110 which has a perimeter flange 112 opposite side portions of which 112*a* and 112*b* together with a bottom portion 112*c* may be suitably spot welded to the parts of the body member 100 contiguous with these flanges. The side parts 104 and 106 of the body 100 also suitably support elongated channel shaped slide guide members 113 similar to the channel shaped guide members previously described for the desk 32.

As shown in FIGS. 11 and 12, the drawer front head 108 is characterized by a panel 114 which may be fabricated of the same materials and have the same structural features as the panels 38 and 78, for example, and includes a suitable arcuate recess 116 to form clearance for a drawer pull and front head member comprising a folded metal plate 118 having a planar back part 120 secured to the flanges 104*b* and 106*b* by spot welding, for example. A curved front part 122 is disposed partially over the recess 116 and defines a drawer pull. The panel 114 is operable to be removably fastened to the head member 118 by suitable fasteners whereby the panel 114 may be interchanged with panels having different ornamental features or finishes. Accordingly, the drawer 75 has an aesthetically pleasing appearance and has a functional drawer pull formed by the member 122 and the recess 116 in panel 114 without employing removable knobs or handles.

Referring further to FIGS. 11 and 13, the body side parts 104 and 106 are each provided with respective opposed slots 126, as shown in FIG. 11. Referring to FIG. 13 by way of example, an angle or somewhat L-shaped drawer stop member 128, having opposed legs 129 and 130, is operable to have its leg 129 project through the slot 126 to the exterior of the drawer side part 104. Stop members 128 may be provided for support on each drawer side part 104 and 106. A cylindrical bore 131 is formed in each of the drawer side parts 104 and 106 below the slot 126 for receiving a blind nut member 132 forcibly retained therein by an interference fit, for example. A threaded fastener 134 is engageable with member 132 to secure the stop member 128 to the side part 104 with the leg 129 of the stop member projecting through the slot 126. As shown in FIGS. 9 and 10, the drawer slide guide support members 87*b* have respective laterally projecting tabs 87*d* formed thereon for each of the drawers 75. When the drawers 75 are installed in chest assembly 74 supported on the assemblies 87 and the stop members 128 are installed on the side parts 104 and/or 106, tabs 87*d* are engageable with the leg 129 of each stop member 128 for each drawer to prevent removal of each of the drawers from the cabinet assembly 74 without first removing the fasteners 134 and the stop members 128 from their working positions in each drawer, respectively.

Figure 14:
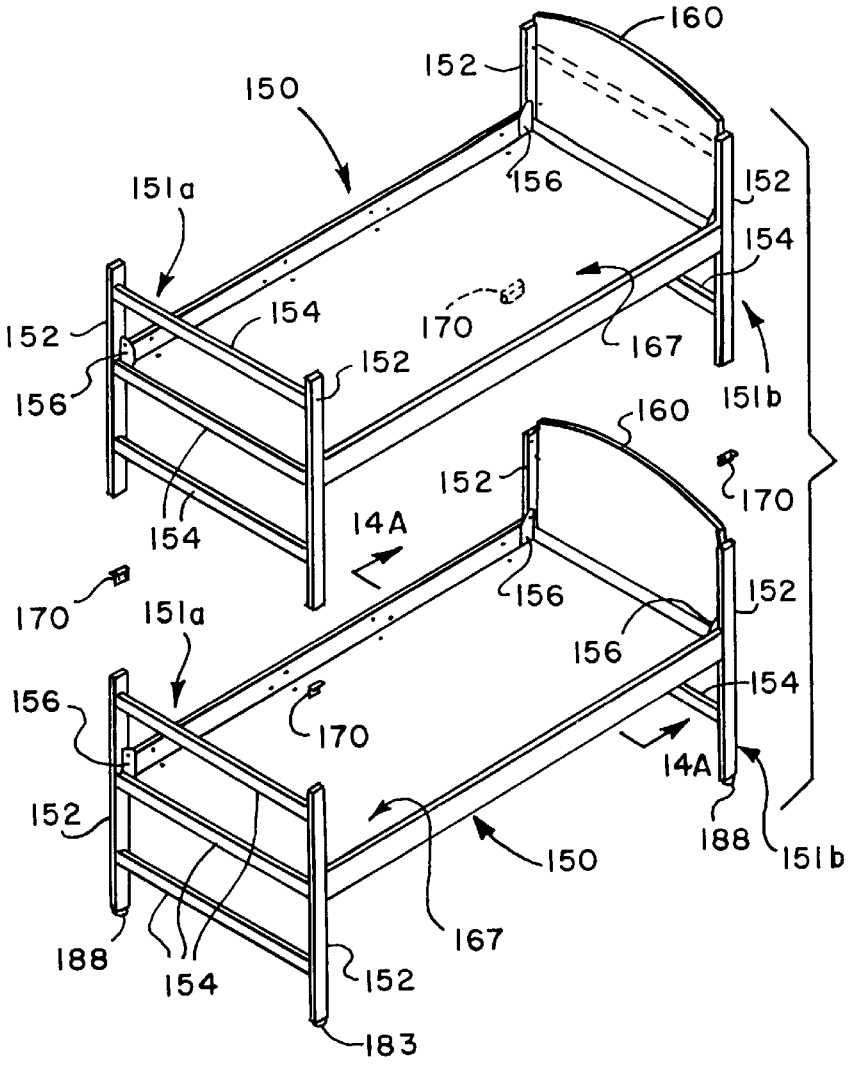
FIG. 14 is a perspective view of two vertically stackable beds in accordance with the invention.
Figure 15:
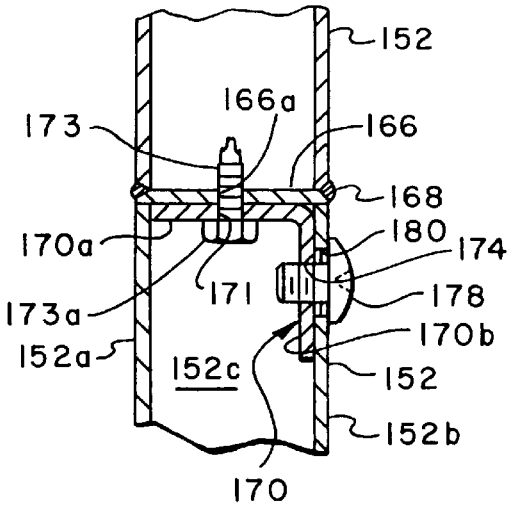
FIG. 15 is a detail section view showing a connecting bracket between the legs or posts of the vertically stacked beds shown in FIG. 14.
Figure 16:
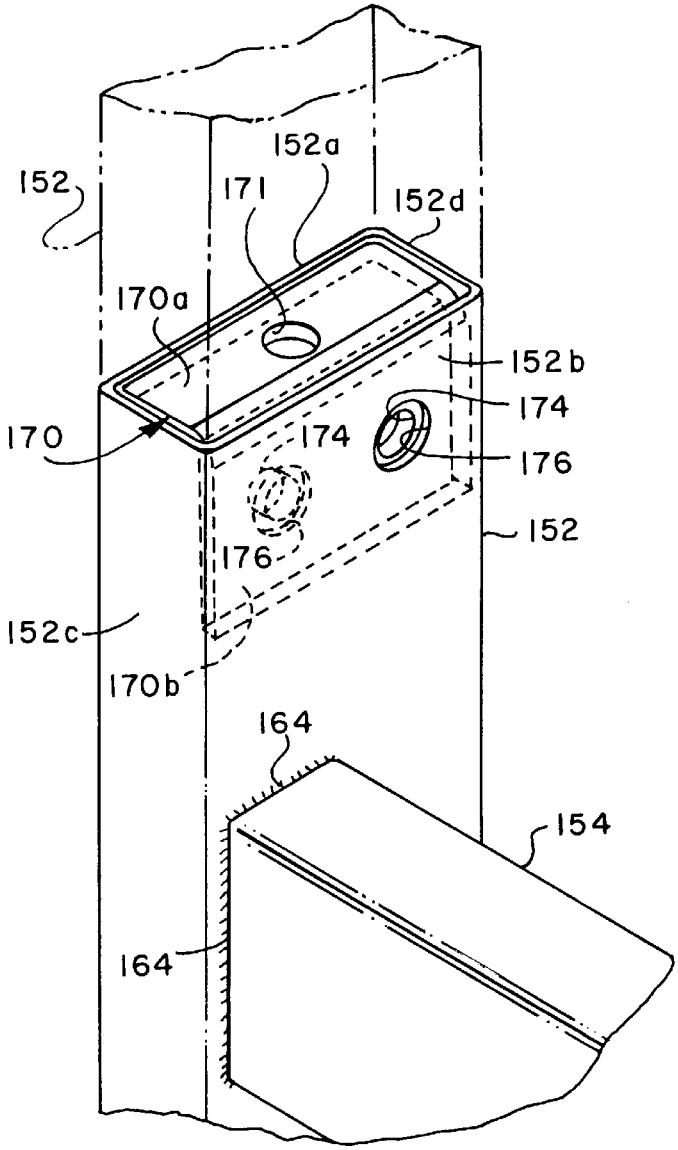
FIG. 16 is a detail perspective view of the brackets shown in FIG. 15 in a working position nested within the top of a post of the lower bed of the set of beds shown in FIG. 14.

Referring now to FIGS. 14 through 16, durable furniture articles comprising so-called bunk type beds are illustrated and generally designated each by numeral 150. Beds 150 are characterized by spaced apart, opposed end frames 151*a* and 151*b*, each comprising two generally vertically extending rectangular cross section tubular corner posts or legs 152, interconnected by and welded to spaced apart, generally parallel rails 154. The rails 154 may comprise rectangular cross section tubular members welded to the posts 152 at 164, FIG. 16, for example. Welding 164 may extend all around the periphery of the ends of each of the frame members 154 which are contiguous with the posts 152. End frame 151*b* supports a headboard 160 between its two posts 152.

Figure 14A:
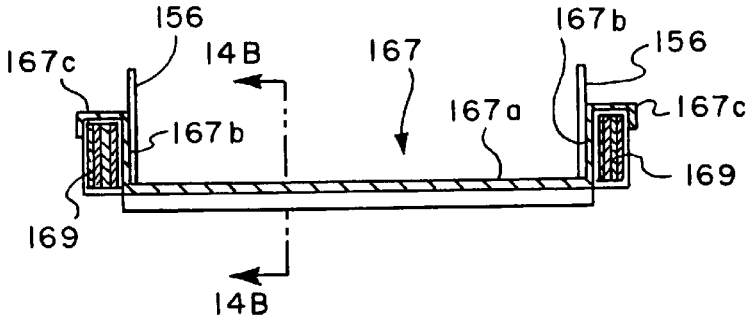
FIG. 14A is a section view taken from line 14A—14A of FIG. 14.
Figure 14B:
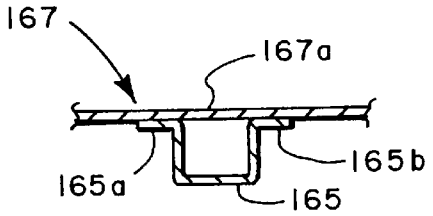
FIG. 14B is a section view taken from line 14B—14B of FIG. 14A.

Referring further to FIGS. 14, 14A and 14B, each of the beds 150 includes a mattress support deck, generally designated by the numeral 167, which comprises a folded metal plate, including a deck part 167*a*, see FIG. 14A, and opposed, elongated, upstanding side flange portions 167*b* which are folded over at their upper distal edges to form a channel portion 167*c*. Elongated solid wood or plywood frame rail members 169 are suitably nested in the channel portions 167*c* and are also secured to the upstanding side flanges 167*b* by suitable fasteners, not shown. The rail members 169 may be provided with a laminated plastic covering of the type described previously for the panels 38, 76 and 78, for example. Opposite corners of the deck 167 are provided with upstanding brackets 156 suitably welded thereto and adapted to be connected to the end frames 151*a* and 151*b* by suitable fasteners, not shown, or by welding, if desired. As further shown in FIGS. 14A and 14B, spaced apart reinforcing members 165 are secured to the deck 167, as illustrated. Each of the reinforcing members 165, one shown, may comprise a folded metal plate member forming a channel or inverted "hat" cross-section member having opposed flanges 165*a* and 165*b* which may be suitably spot-welded to the deck part 167*a* of the deck 167.

Referring further to FIGS. 15 and 16, in particular, the beds 150 are vertically stackable and securable to each other by fastening means adapted to interconnect abutting ends of the posts 152 when one bed is stacked on top of the other and with the respective posts 152 aligned with each other. The lower distal end of each post or leg 152 includes a transverse bottom plate 166, which is suitably secured to the bottom of a post 152 such as by a perimeter weld 168. A threaded or pilot bore 166*a* is formed, preferably centrally, in the plate 166. The rectangular tubular posts 152 may be formed of seamless or otherwise formed generally rectangular cross section tubing having opposed side walls 152*a* and 152*b* interconnected by opposed end walls 152*c* and 152*d*.

A somewhat L-shaped anchor bracket 170 is provided for anchoring each of the posts 152 of the upper bunk bed 150 to the corresponding post of the lower bunk bed 150. Each anchor bracket 170 includes opposed legs 170*a* and 170*b* which extend substantially at right angles to each other and are dimensioned such that the anchor bracket 170 will fit within the interior space of a post 152, as shown in FIGS. 15 and 16, in snug fitting but slidable relationship to the side walls 152*a*, 152*b* and the end walls 152*c* and 152*d*. Bracket leg 170*a* has a suitable bore 171 formed therein and positioned to be aligned with the bore 166*a* in the bottom plate 166 whereby a threaded fastener 173, which may be a machine screw, may be inserted through the leg 170 and threadedly engaged with the bottom plate 166. The fastener 173 may have a hex head 173*a* or other suitable conventional head portion.

As further shown in FIGS. 15 and 16, bracket leg 170*b* also includes a suitable bore 174 positioned to be aligned with a corresponding bore 176 formed in side wall 152*b*. Bore 176 may be larger than bore 174 and bore 174 may be suitably internally threaded for receiving a machine screw 178 for securing the bracket 170 and the leg 152 of the bed above against dislodgement from the bed below. Bore 176 may be large enough to receive a suitable lock washer 180 disposed therein and having a thickness sufficient to engage the underside of the head of fastener 178 as well as the leg 170*b* of the anchor bracket 170, but also being sufficiently hidden so as not to snag bed clothes or other articles which may come in proximity to the fasteners 178 when they are in their working positions. More than one bore 174 and 176 may be provided in the respective members comprising the bracket 170 and the leg wall 152*b*, suitably spaced apart, as indicated by the phantom lines in FIG. 16. However, typically only one fastener 178 may be required for suitably securing the bracket 170 in its working position shown in FIGS. 15 and 16. As indicated in FIG. 14, brackets 170 are provided for each of the legs 152 of each bed so that all four legs 152 of the upper bunk bed 150 are anchored to the corresponding leg 152 of the lower bunk bed 150.

The beds 150 are vertically stacked and secured to one another by first removing any support feet, such as the feet or glides 188 (shown attached to the bottom of the legs 152 of the lower bed 150), from the bottom plate 166 of each of the legs or posts 152 of the upper bed. Brackets 170 are then secured to the plates 166 at the lower ends of the posts 152 of the upper bed by fasteners 173. The upper bed 150 is then positioned on top of the lower bed 150 and the brackets 170 are lowered into the interior spaces 152*e* of the posts of the lower bed with the bores 174 aligned with the bores 176 whereby fasteners 178 may be engaged with the bracket legs 170*b*, preferably with lock washers or the like 180 interposed therebetween. The beds 150 are thus securely stacked one on top of the other. The attachment may be made secure by application of tamper-resistant fasteners 178 or otherwise modifying the heads of the fasteners to prevent application of a tool thereto for removal from the respective posts 152.

Figure 17:
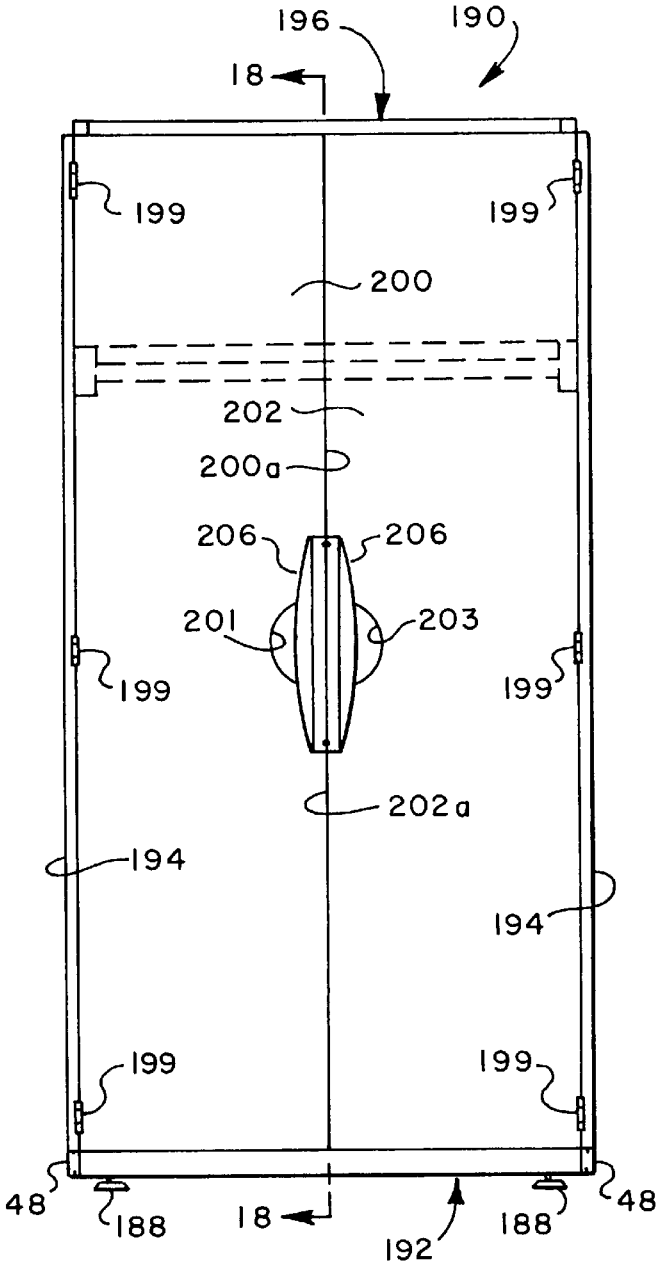
FIG. 17 is a front elevation of an enclosure or wardrobe unit in accordance with the preferred embodiment of the present invention.

Referring now to FIGS. 17 through 22, and FIGS. 17, 18 and 19, in particular, a storage or wardrobe unit 190 is illustrated. The wardrobe unit 190 is characterized by a base frame 192, opposed generally rectangular and planar side panels 194, an upper rigidizing boxlike enclosure 196 interposed between the side panels, a generally rectangular planar back wall part 198 and opposed, generally rectangular planar doors 200 and 202 which are hinged to the side panels 194, respectively. The side panels 194 may be formed of the same material and in substantially the same manner as the side panels 38 and 78 of the desk 32 and the chest assembly 74, respectively. The bottom side edges of the side panels 194 are preferably covered by channel shaped guard members 48 and end caps 50 to protect the edges of the side panels. The base frame 192 is supported on spaced apart feet or glides 188 in the same manner as the bed 150, or the desk 32 and chest assembly 74. The door 200 is hinged to a forward side edge of one side panel 194 by spaced part, conventional, so-called hospital hinge assemblies 199 as shown in FIG. 17. In like manner, door 202 is hinged to the forward side edge of the other side panel 194 at spaced apart hinge assemblies 199. Each of the doors 200 and 202 has a suitable recess 201 and 203 formed therein, respectively, and disposed adjacent respective pull handles 206 which are secured to the respective doors along their adjacent edges 200*a* and 202*a*, respectively.

Figure 19:
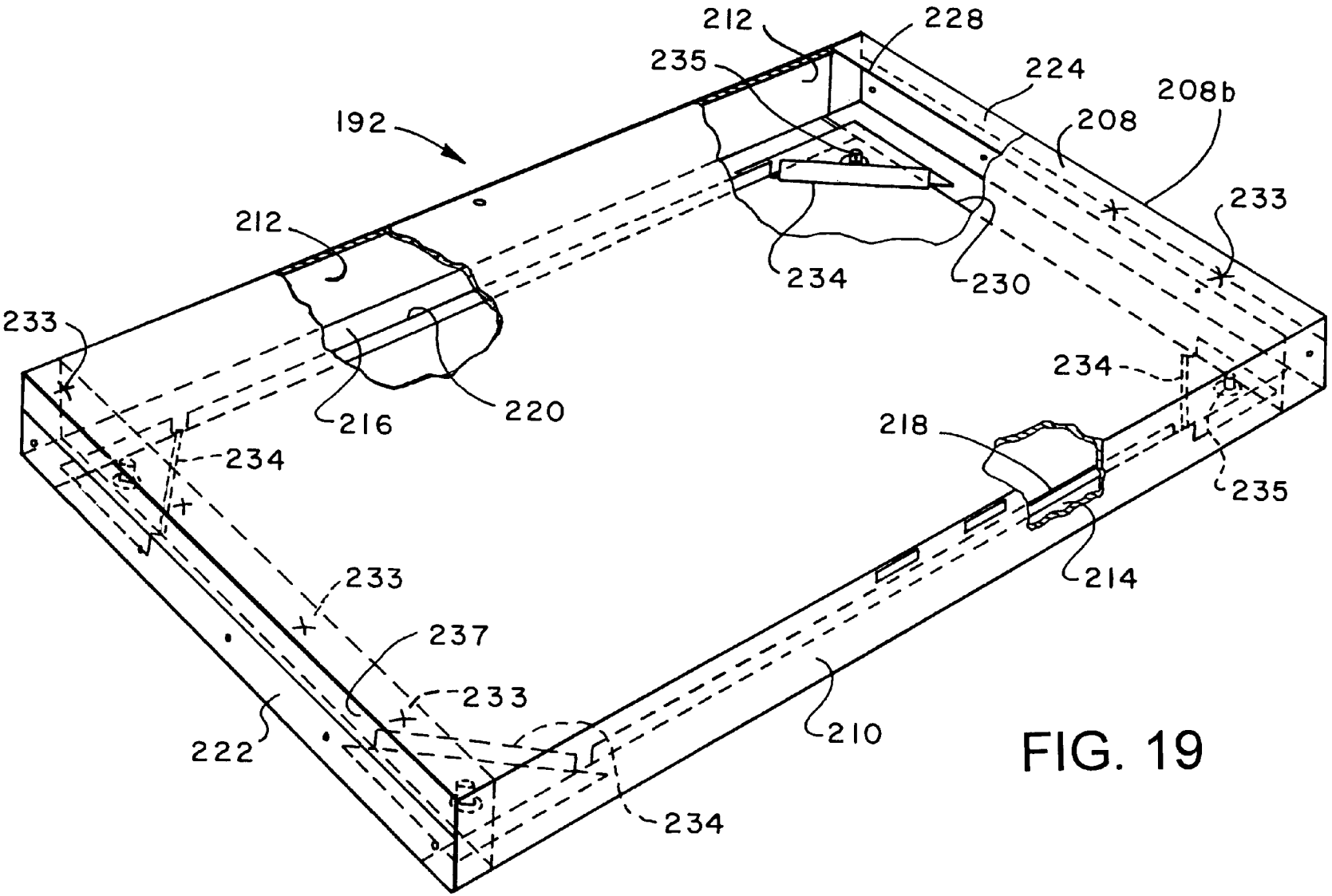
FIG. 19 is a perspective view of a base frame for the wardrobe unit shown in FIG. 17.

Referring now to FIGS. 19 and 19A, the base frame assembly 192 is characterized by a member 208 comprising a metal plate which is folded downwardly at spaced apart points to form opposed, parallel front and rear sides 210 and 212, respectively. Each of the sides 210 and 212 is characterized by a folded web portion 214 and 216, respectively, then an upturned flange 218 and 220, respectively, to further strengthen the base frame plate. The flanges 218 and 220 terminate short of the opposed side edges 208*a* and 208*b* of the plate 208, thereby leaving a space for receiving folded end plates 222 and 224, respectively. The end plates 222 and 224 may be substantially identical in construction and are each characterized by a vertically extending web portion 226, see FIG. 19A, for plate 222, folded top and bottom sides 228 and 230, and folded opposed ends 232, to form a generally rectangular box dimensioned to fit closely within each end of the member 208. Upon assembly of the end plate members 222 and 224 to the base frame member 208, suitable welds 233 may be provided along the contiguous portions of the member 208 with the sides 228 and ends 232 of the respective end plate members 222 and 224.

The base frame 192 is further reinforced by generally triangular shaped gussets 234 which are disposed across the corners of the member 208 on the underside thereof and are suitably welded to the web portions 214, 216 and the bottom sides 230 of the respective end plate members 222 and 224. As further shown in FIG. 21, by way of example, each of the gussets 234 may be provided with a suitable threaded boss 235 for receiving a support member 51*a* for each of the glides or feet 51. As further shown in FIG. 21, by way of example, each of the doors 200 and 202 is held in a closed position by a fully mortised or flush magnetic latch 236 supported on the depending side part 210 of member 208 of the base frame assembly 192. As further illustrated in FIGS. 19 and 19A, a spacer and reinforcing plate 237 is preferably welded to the outside surface of each of the end plate members 222 and 224 to form a spacer for accommodating the thickness of the channel-shaped guard members 48 disposed along the lower sides of the side panels 194 when the panels 194 are secured to the base frame assembly 192. The members 237 also add some reinforcement to the end plate members 222 and 224 of the base frame assembly 192.

Figure 18:
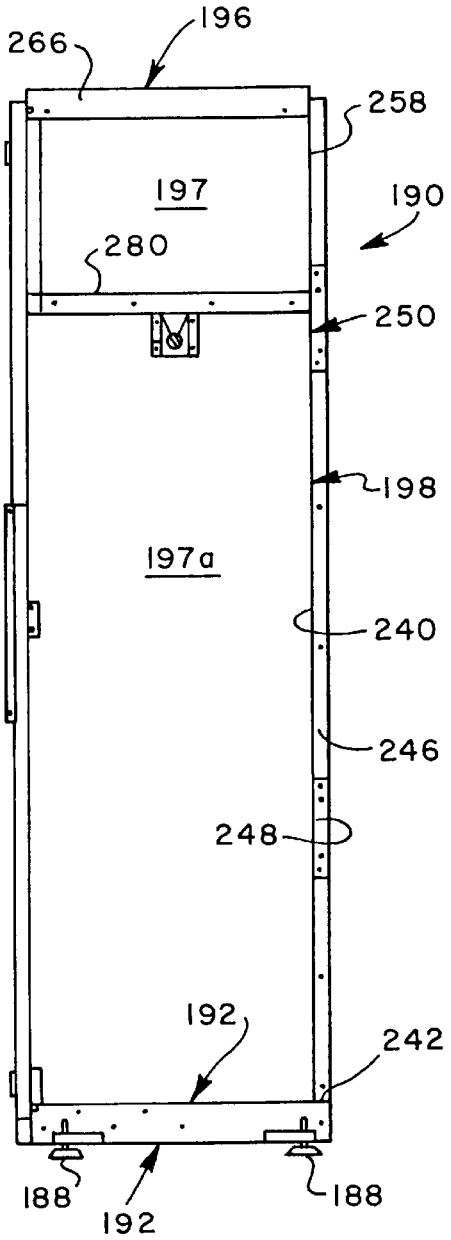
FIG. 18 is a section view taken from the line 18—18 of FIG. 17.

Referring further to FIGS. 18 and 20, the back wall 198 is preferably characterized by a metal plate having a generally planar plate portion 240, a folded transverse bottom edge 242, opposed folded vertical side edges 244 and 246 and a folded top edge or hem 250. The side edges 244 and 246 are suitably secured to the side panels 194 by spaced apart fasteners and the bottom side edge 242 is also secured to the base frame 192 by suitable spaced apart fasteners.

Figure 20A:
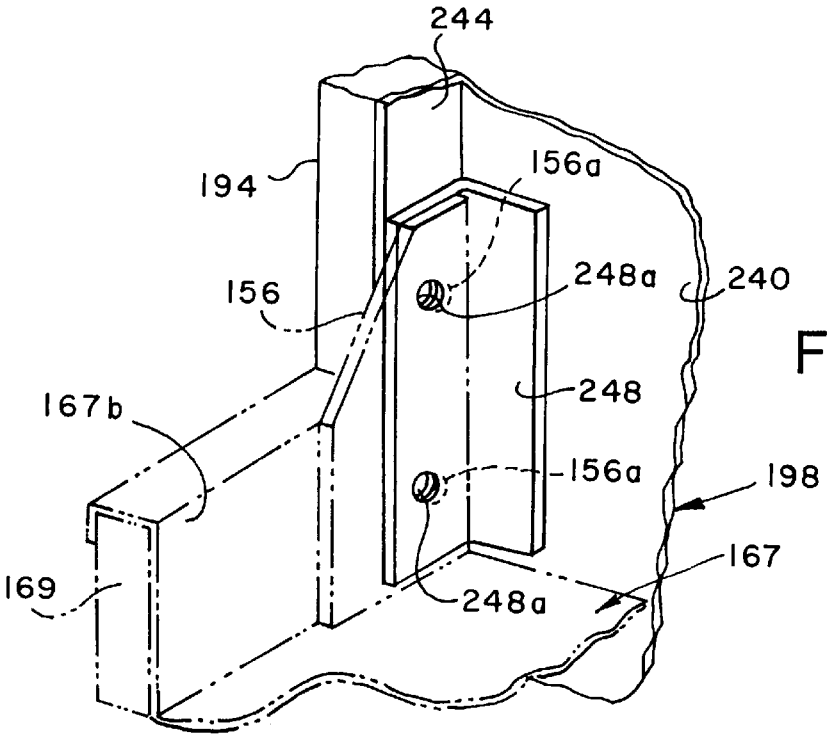
FIG. 20A is a detail view showing a connection between a bed and wardrobe unit in accordance with the invention.

Referring further to FIG. 20 and FIG. 20A, the unit 190 also includes two pairs of spaced apart opposed angle or somewhat L-shaped support brackets 248 which are, as shown in FIG. 28, respectively secured to the side edges 244 and 246 of the back wall 198. One pair of brackets 248 is supported adjacent the hem 250, as illustrated. As shown by example in FIG. 20A, each of the brackets 248 includes spaced apart threaded bores 248*a* which are particularly adapted to provide for connecting opposed brackets 156 of the beds 150, respectively, to the unit 190 whereby the unit 190 may be substituted for one or the other of the end frames 151*a* or 15*b*. In particular, if an end frame 151*b*, supporting a head board 160 is replaced by connecting the respective bunk beds 150 to the unit 190, then the back wall 198 of the unit, together with the enclosure 196 may serve as head boards for the respective beds 150. Of course, only one bed 150 may be secured to the lower set of brackets 248 if a second bed is not stacked on top of the lower bed. Accordingly, an important advantage of the beds 150 and the unit 190 is provided by the configuration of the brackets 248 and the brackets 156 whereby one or both ends of the beds may be supported by a unit or units 190, respectively.

Referring now to FIGS. 22, 22A and 22B, the enclosure 196 is shown in an exploded perspective view and is characterized by a first member 256 which is a folded metal plate defining a back wall 258 and opposed side walls 260 and 262. The side walls 260 and 262 are delimited by forward opposed coplanar side portions 261 and 263 which are folded at 261*a* and 263*a* and further folded at 264, respectively, to form respective stiffening channel shaped side edges of member 256. A generally horizontally extending top wall member 266 of the enclosure 196 is formed of a metal plate which has a generally horizontal planar top wall part 268 delimited by downwardly folded front and rear edges 270 and 272 and opposed side edges 274 and 276. The front edge 270 is delimited by a fold which forms a web 271 and an upturned distal flange 273, see FIG. 22A. The top wall member 266 thus forms a shallow inverted rectangular pan having the web and flange portion 271, 273 formed across the front edge 270 and dimensioned to nest within the member 256 and be located in its working position by the top edges of the channels formed by the above-described side edges of member 256.

The enclosure 196 further includes a shelf and bottom wall member 280 including a generally rectangular planar shelf portion 282, a rear depending flange 284 and opposed depending side flanges 286 and 288. A front edge of the shelf member 282 is formed by a folded depending web 290, see FIG. 22B also, a second web 292 extending generally horizontally and an upturned distal flange portion 294. The shelf member 282 may be formed by folding the depending portions 284, 286, 288, 290, 292 and 294 from a single metal plate. The dimensions of the shelf member 282 are such as to allow it to nest within the member 256 in a manner similar to the top wall member 266. The members 256, 266 and 280 may be suitably welded together along their contiguous surfaces by spot welds. In addition, suitable sets of fastener receiving openings 257 may be provided in the side wall portions 260, 262, the depending side edges 274 and 276 and the depending flange portions 286 and 288 for securing the enclosure to the side panels 194 by suitable fasteners which may be adapted to extend through the aforementioned fastener receiving openings 257 and then be engageable with the side panels 194 to suitably support the enclosure 196 between the side panels 194 and primarily to strengthen the unit 190.

Figure 20B:
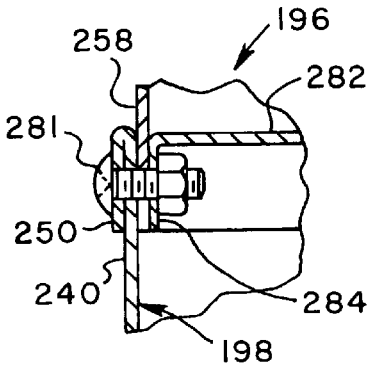
FIG. 20B is a detail section view taken from line 20B–20B of FIG. 20.
Figure 21:
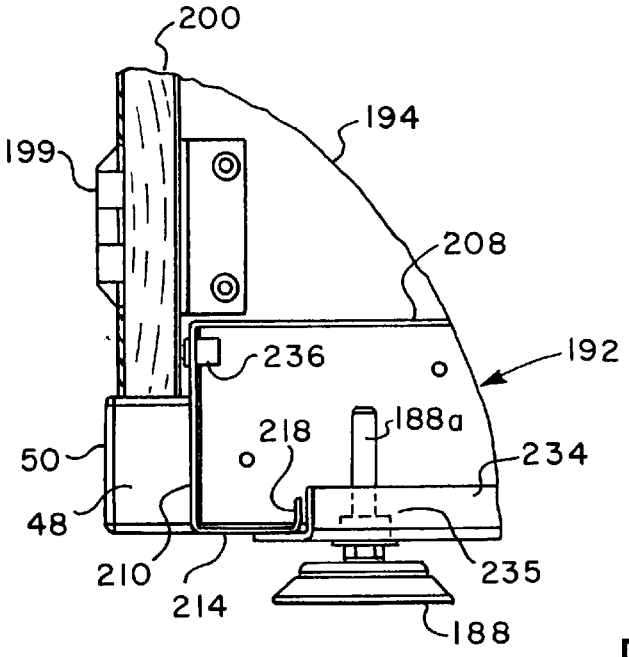
FIG. 21 is a detail view, taken from line 18—18 on a larger scale, showing one of the door hinges and a support foot for the wardrobe unit of FIG. 17.

Referring now briefly to FIG. 20B, enclosure 196 is secured to the back wall 198 by a plurality of spaced apart bolt assemblies 281, one shown, wherein suitable bolt receiving holes are formed in the plate portion 240 and the hem 250 as well as in the back wall 258 and the depending flange 284 of the enclosure 196. Plural bolt assemblies 281 may be disposed in suitable bores in the above-described members spaced apart along the width of the back wall 198. In this way, the enclosure 196 is rigidly secured to the back wall 198 to further strengthen the unit 190.

As previously mentioned, the side panels 194 and the doors 200 and 202 may be formed of the laminated materials described above in conjunction with the description of the desk side panels 38. The base frame assembly 192 and the enclosure 196 may be formed of sheet metal, such as steel, suitably folded as described and the component parts of each assembly welded together at contiguous surfaces by spaced apart spot welds. The back wall 198 may also be formed of a suitable sheet metal, such as steel, folded to provide the bottom edge 242 and the side edges 244 and 246 and the hem 250. Accordingly, the wardrobe unit 190 is advantageously constructed of durable materials and is assembled in a manner which provides a strong, durable and novel construction.

Figure 23:
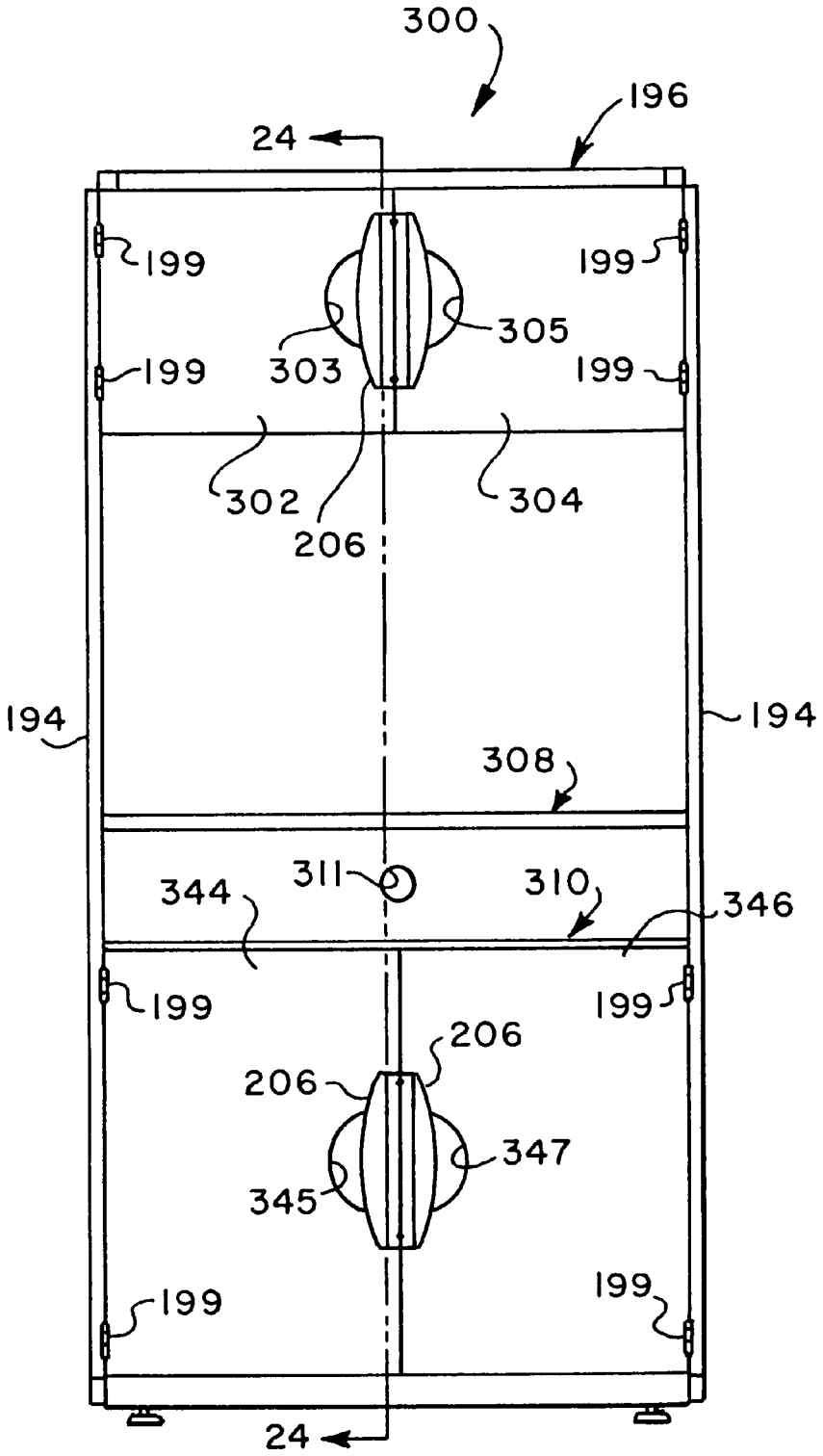
FIG. 23 is a front elevation of a cabinet or storage unit utilizing several components of the wardrobe unit shown in FIGS. 17 through 22.
Figure 24:
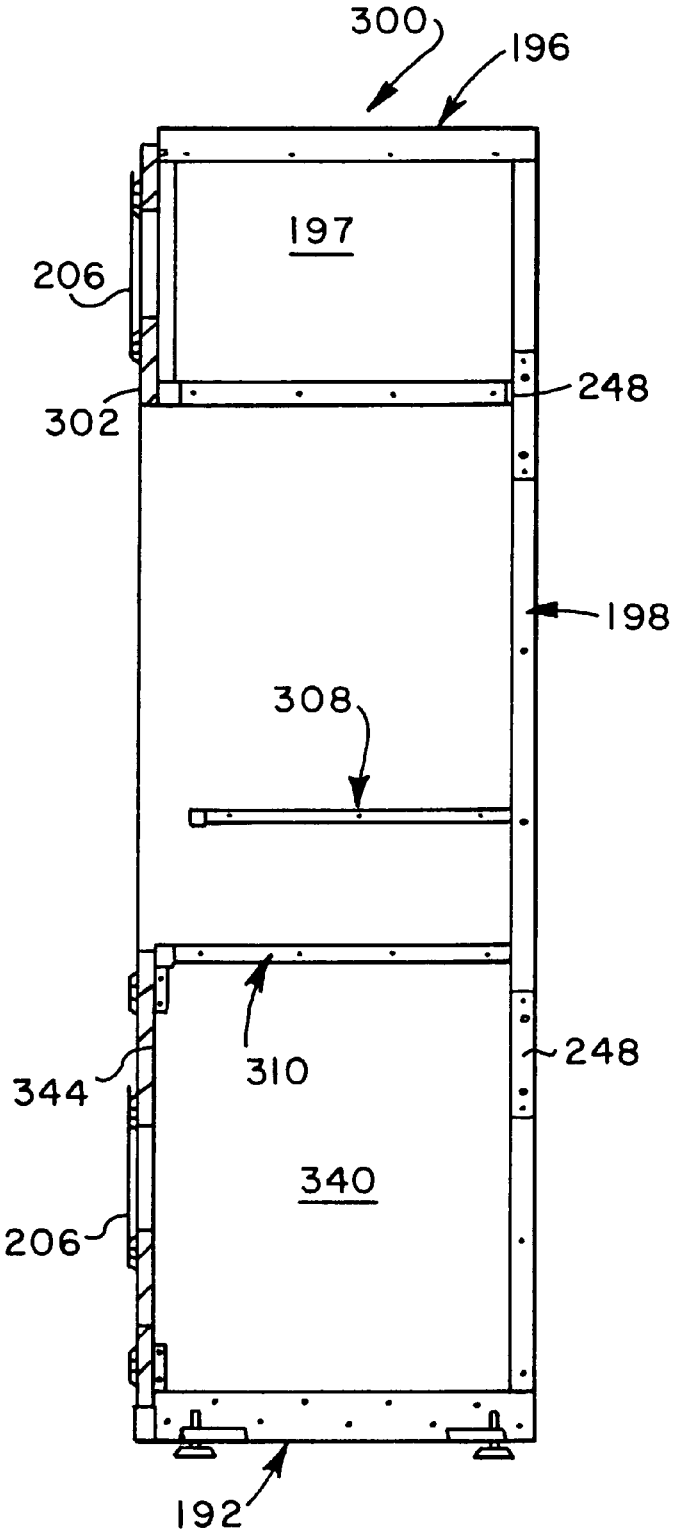
FIG. 24 is a section view taken from the line 24—24 of FIG. 23.
Figure 25:
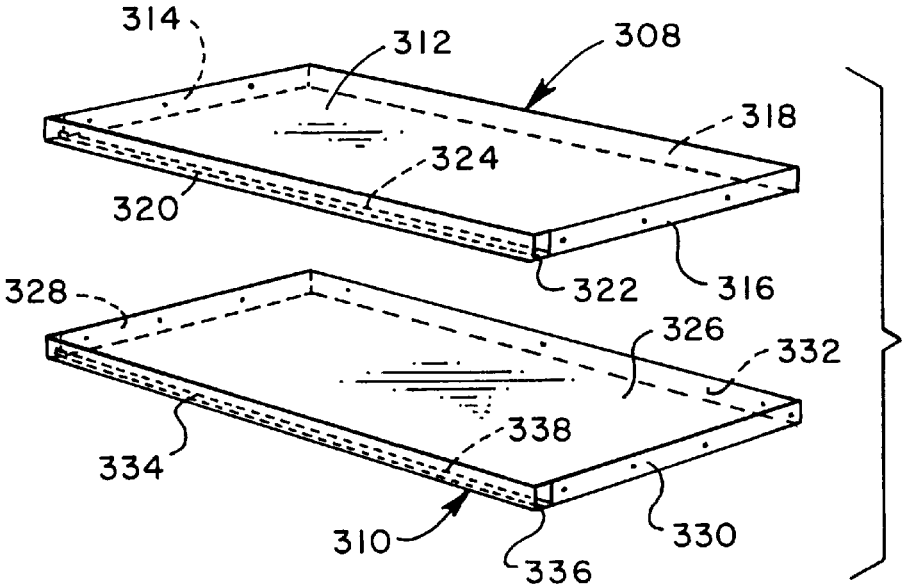
FIG. 25 is an exploded perspective view of the shelf members of the storage unit shown in FIGS. 23 and 24.

Referring now to FIGS. 23 through 25, the wardrobe unit 190 may be modified to provide a similar enclosure without doors 200 and 202 which cover the entire enclosure space 197*a* formed by the wardrobe unit. The modified furniture article shown in FIGS. 23 and 24 is designated by the numeral 300 and utilizes the base frame assembly 192, the outer side panels 194, the enclosure 196 and the back wall 198, all assembled in the same manner as the wardrobe unit 190. However, in place of the doors 200 and 202, there are provided doors 302 and 304 which cover the front of the enclosure 196 and are hinged to the forward side edges of the respective side panels 194 by suitable hinge assemblies 199, respectively. The doors 302 and 304 are each provided with a suitable recess 303 and 305, together with respective pull assemblies 206 supported thereon, respectively.

The furniture article or storage unit 300 includes intermediate shelves 308 and 310 which are secured in the respective positions shown in FIGS. 23 and 24 to the opposed side panels 194 and to the back wall 198 by suitable fasteners, respectively. As shown in FIG. 25, the shelves 308 and 310 are constructed in a manner substantially like that of the shelf and bottom wall member 280 for the enclosure 196. For example, the shelf 308 is formed by a folded metal plate to provide a shelf part 312, depending side edges 314 and 316, a rear edge 318 and a front depending web 320, a transverse web 322 and an upturned distal flange portion 324. The shelf 308 may thus be formed of a folded metal plate similar to the shelf member 280. The shelf member 310 is similarly formed to have a shelf part 326, opposed depending side edges 328 and 330, a rear depending edge 332, a front depending web 334, a transverse web portion 336 and an upturned distal flange portion 338. When the shelves 308 and 310 are assembled in their working positions on the enclosure 300 by suitable fasteners connecting the shelves to the side panels 194 and back wall 198, the rear edges or flanges 318 and 332 are contiguous with the back wall 198 and the shelves have different widths so that the lower shelf is easily accessible, as shown in FIG. 24.

As further illustrated in FIG. 24, an enclosure space 340 is formed by the enclosure unit 300 between the shelf 310 and the base frame assembly 192, between the side panels 194, and between the back wall 198 and opposed hinged doors 344 and 346 which are also hinged to the side panels 194 by spaced apart hinge assemblies 199, respectively. The doors 344 and 346 are also provided with suitable recesses 345 and 347 and door pulls 206 suitably secured thereto, respectively. The doors 302, 304, 344 and 346 may be secured in their closed positions by magnetic latches in a manner similar to the doors 200 and 202 of the wardrobe unit 190. Accordingly, a modular wardrobe unit 190 and an enclosure or storage unit 300 may be easily formed using a substantial commonality of parts, and wherein the differences are primarily the doors which provide access to the enclosure spaces 197, 197*a* and 340, respectively. As shown in FIG. 23. the back wall 198 may be modified to provide a suitable port 311 formed therein for routing electrical cables through the back wall.

The enclosure unit 300 may be assembled in substantially the same manner as the wardrobe unit 190. The side panels 194, the enclosure unit 196 and the back wall 198 are secured to each other in the same manner as for the wardrobe unit 190 and the doors 302, 304, 344 and 346 are secured to the side panels 194 in the same manner as the doors 200 and 202 for the wardrobe unit. Moreover, enclosure unit 300 also includes the bed support brackets 248 secured to the back wall 198, see FIG. 24, whereby the enclosure unit 300 may also be used to support one or two stacked bunk beds 150 in the manner described above. Accordingly, modular storage units such as the wardrobe unit 190 and the enclosure or storage unit 300 may be easily fabricated of a large number of common parts to provide aesthetically pleasing and durable furniture articles of the type described and shown.

The durable furniture articles described hereinabove may be advantageously combined in a suite of such articles. A suite of durable furniture articles may include the desk 30, the chest assembly 74, one or more beds 150, a storage or wardrobe unit 190 and/or a modified wardrobe unit such as the article 300. Of course, not all of the articles need be provided in a particular suite of articles, but a suite of such articles enjoys the benefits of the durable construction provided by the formed and welded metal parts and the construction of components such as the desktop 34, the panels 38, 76 and 78 and the panels 194, for example.

The construction of the durable furniture articles described hereinabove, apart from the detailed description given for each article, may be carried out using conventional manufacturing practices and materials known to those of skill in the art.

While the durable furniture articles of the present invention have been described in connection with preferred embodiments, it is not intended to limit the invention to the particular form set forth, but on the contrary, it is intended to cover such alternatives, modifications, and equivalents as may be included within the spirit and scope of the invention as defined by the appended claims.

What is claimed is:

1. In a furniture article, a drawer adapted to be supported on said furniture article for sliding movement between open and closed positions, said drawer being characterized by:

a panel formed of a first piece of sheet material folded to provide a generally planar bottom panel and opposed, generally vertically extending side panels;

a rear panel of said drawer engageable with said side panels of said drawer and secured thereto;

a front panel of said drawer; and a stop member secured to said drawer on an inside of at least one side panel and projecting through an opening in said one side panel and engageable with means on said furniture article to prevent removal of said drawer from said furniture article.

2. The drawer set forth in claim 1 wherein:

said stop member comprises an angle member having opposed legs, one of said legs projecting through said opening and the other of said legs being engageable with a fastener for releasably securing said stop member to said one side panel.

3. A drawer adapted to be supported on a furniture article for sliding movement between open and closed positions, said drawer being characterized by:

a continuous panel formed of a first single piece of sheet material folded to provide a generally planar bottom panel and opposed, generally vertically extending planar side panels, said side panels each including an upper longitudinal edge terminating in respective flanges formed by folding said upper edges outwardly away from each other, respectively, said side panels each being delimited by front vertical side edges folded outwardly away from each other to form opposed front side edge flanges;

a rear panel of said drawer comprising a second and separate piece of sheet material folded along opposite sides to provide at least two opposed planar flanges engageable with said side panels of said drawer and secured to said side panels, respectively;

a front head including a substantially planar portion secured directly to said opposed front side edge flanges, respectively;

a front panel of said drawer separate from and connected to said front head; and wherein said drawer includes a stop member secured to said drawer on an inside of at least one side panel and projecting through said one side panel; and said stop member is engageable with cooperating means on said furniture article to prevent removal of said drawer from said furniture article.

4. A drawer adapted to be supported on a furniture article for sliding movement between open and closed positions, said drawer being characterized by:

a continuous panel formed of a first single piece of sheet material folded to provide a generally planar bottom panel and opposed, generally vertically extending planar side panels said side panels each including an upper longitudinal edge terminating in respective flanges formed by folding said upper edges outwardly away from each other, respectively, said side panels each being delimited by front vertical side edges folded outwardly away from each other to form opposed front side edge flanges;

a rear panel of said drawer comprising a second and separate piece of sheet material folded along opposite sides to provide at least two opposed planar flanges engageable with said side panels of said drawer and secured to said side panels, respectively;

a front head including a substantially planar portion secured directly to said opposed front side edge flanges, respectively;

a front panel of said drawer separate from and connected to said front head; and wherein said front head is formed of at least one piece of sheet material, including said planar portion of said front head having a top edge and folded over along said top edge to define a drawer pull, and said front panel includes a top edge and a recess formed in said top edge of said front panel adjacent said drawer pull to provide access to said drawer pull by a person's hand for grasping said drawer pull.

* * * * *